US007449085B2

(12) United States Patent
Hermans et al.

(10) Patent No.: US 7,449,085 B2
(45) Date of Patent: Nov. 11, 2008

(54) PAPER SHEET HAVING HIGH ABSORBENT CAPACITY AND DELAYED WET-OUT

(75) Inventors: Michael Alan Hermans, Neenah, WI (US); Richard Joseph Behm, Appleton, WI (US); Mike Thomas Goulet, Neenah, WI (US); Mark John Hassman, Appleton, WI (US); Jeffrey Janne Johnson, Neenah, WI (US); Jeffrey Dean Lindsay, Appleton, WI (US); Rebecca Catherine Mohr, Appleton, WI (US); Maurizio Tirimacco, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/591,798

(22) Filed: Nov. 1, 2006

(65) Prior Publication Data

US 2007/0051484 A1 Mar. 8, 2007

Related U.S. Application Data

(62) Division of application No. 10/654,286, filed on Sep. 2, 2003, now abandoned.

(51) Int. Cl.
*D21H 19/10* (2006.01)
*D21H 27/30* (2006.01)

(52) U.S. Cl. ..... 162/109; 162/123; 162/135; 162/149; 428/172; 428/195.1

(58) Field of Classification Search ..... 162/109, 162/111–113, 134–135, 158, 123–133, 141, 162/149; 428/537.5, 195.1, 156, 172
See application file for complete search history.

(56) References Cited

U.S. PATENT DOCUMENTS

| | | | |
|---|---|---|---|
| 2,624,245 | A | 1/1953 | Cluett |
| 3,011,545 | A | 12/1961 | Welsh et al. |
| 3,017,317 | A | 1/1962 | Voigtman et al. |
| 3,096,228 | A | 7/1963 | Day et al. |
| 3,260,778 | A | 7/1966 | Walton |
| 3,301,746 | A | 1/1967 | Sanford et al. |
| 3,329,556 | A | 7/1967 | McFalls et al. |
| 3,359,156 | A | 12/1967 | Freuler et al. |
| 3,416,192 | A | 12/1968 | Packard |
| 3,426,405 | A | 2/1969 | Walton |
| 3,554,863 | A | 1/1971 | Hervey et al. |
| 3,630,837 | A | 12/1971 | Freuler |
| 3,660,338 | A | 5/1972 | Economou |
| 3,686,151 | A | 8/1972 | Keim |
| 3,700,623 | A | 10/1972 | Keim |
| 3,772,076 | A | 11/1973 | Keim |
| 3,821,068 | A | 6/1974 | Shaw |
| 3,879,257 | A | 4/1975 | Gentile et al. |
| 3,903,342 | A | 9/1975 | Roberts, Jr. |
| 3,926,716 | A | 12/1975 | Bates |
| 3,994,771 | A | 11/1976 | Morgan, Jr. et al. |
| 4,000,237 | A | 12/1976 | Roberts, Jr. |
| 4,072,557 | A | 2/1978 | Schiel |
| 4,090,385 | A | 5/1978 | Packard |
| 4,125,659 | A | 11/1978 | Klowak et al. |
| 4,144,122 | A | 3/1979 | Emanuelsson et al. |
| 4,158,594 | A | 6/1979 | Becker et al. |
| 4,208,459 | A | 6/1980 | Becker et al. |
| 4,326,000 | A | 4/1982 | Roberts, Jr. |
| 4,351,699 | A | 9/1982 | Osborn, III |
| 4,440,597 | A | 4/1984 | Wells et al. |
| 4,442,833 | A | 4/1984 | Dahlen et al. |
| 4,483,332 | A | 11/1984 | Rind |
| 4,507,173 | A | 3/1985 | Klowak et al. |
| 4,528,239 | A | 7/1985 | Trokhan |
| 4,529,480 | A | 7/1985 | Trokhan |
| 4,529,489 | A | 7/1985 | McDonald et al. |
| 4,610,743 | A | 9/1986 | Salmeen et al. |

(Continued)

FOREIGN PATENT DOCUMENTS

| | | | |
|---|---|---|---|
| DE | 34 41 883 | A1 | 11/1984 |

(Continued)

OTHER PUBLICATIONS

"Airflex 426 Emulsion," Air Products Polymers, L.P., 2-page brochure and Internet web page"http://airproducts.com/polymers/controlled/product_description?intRegionalMarketSegment=55 . . . " printed Jul. 1, 2003, 2 pages and 1 page Specifications.

(Continued)

*Primary Examiner*—José A Fortuna
(74) *Attorney, Agent, or Firm*—Gregory E. Croft

(57) ABSTRACT

Absorbent paper products, such as paper towels, are disclosed which have a combination of high absorbent capacity and a moderate to low rate of absorbency for hand protection. These properties can be produced, for example, using a throughdried basesheet, such as an uncreped throughdried sheet, in which at least one surface of which has been printed with a patterned moisture barrier coating and creped. The presence of the moisture barrier coating on the surface retards the absorbent rate for that side of the sheet while allowing a significant amount of liquid to pass through to the center of the sheet.

11 Claims, 14 Drawing Sheets
(4 of 14 Drawing Sheet(s) Filed in Color)

U.S. PATENT DOCUMENTS

| | | | | |
|---|---|---|---|---|
| 4,637,859 | A | 1/1987 | Trokhan | |
| 4,710,374 | A | 12/1987 | Grollier et al. | |
| 4,785,030 | A | 11/1988 | Noda et al. | |
| 4,822,453 | A | 4/1989 | Dean et al. | |
| 4,859,527 | A | 8/1989 | Distefano | |
| 4,891,249 | A | 1/1990 | McIntyre | |
| 4,919,877 | A | 4/1990 | Parsons et al. | |
| 4,944,960 | A | 7/1990 | Sundholm et al. | |
| 4,949,668 | A | 8/1990 | Heindel et al. | |
| 4,996,091 | A | 2/1991 | McIntyre | |
| 5,124,188 | A | 6/1992 | Roe et al. | |
| 5,129,988 | A | 7/1992 | Farrington, Jr. | |
| 5,143,776 | A | 9/1992 | Givens | |
| 5,196,470 | A | 3/1993 | Anderson et al. | |
| 5,200,036 | A | 4/1993 | Noda | |
| 5,264,468 | A | 11/1993 | Miyahara | |
| 5,312,863 | A | 5/1994 | Van Rheenen et al. | |
| 5,334,289 | A | 8/1994 | Trokhan et al. | |
| 5,342,875 | A | 8/1994 | Noda | |
| 5,366,785 | A | 11/1994 | Sawdai | |
| 5,399,412 | A | 3/1995 | Sudall et al. | |
| 5,429,686 | A | 7/1995 | Chiu et al. | |
| 5,443,691 | A | 8/1995 | Phan et al. | |
| 5,484,825 | A | 1/1996 | Dick et al. | |
| 5,494,554 | A | 2/1996 | Edwards et al. | |
| 5,529,664 | A | 6/1996 | Trokhan et al. | |
| 5,529,665 | A | 6/1996 | Kaun | |
| 5,547,710 | A | 8/1996 | Satgurunathan et al. | |
| 5,556,509 | A | 9/1996 | Trokhan et al. | |
| 5,575,891 | A | 11/1996 | Trokhan et al. | |
| 5,593,545 | A | 1/1997 | Rugowski et al. | |
| 5,607,551 | A | 3/1997 | Farrington, Jr. et al. | |
| 5,610,215 | A | 3/1997 | Nonweiler et al. | |
| 5,614,061 | A | 3/1997 | Van Phan et al. | |
| 5,614,597 | A | 3/1997 | Bower | |
| 5,637,194 | A | 6/1997 | Ampulski et al. | |
| 5,656,132 | A | 8/1997 | Farrington, Jr. et al. | |
| 5,667,636 | A | 9/1997 | Engel et al. | |
| 5,672,248 | A | 9/1997 | Wendt et al. | |
| 5,674,590 | A | 10/1997 | Anderson et al. | |
| 5,679,222 | A | 10/1997 | Rasch et al. | |
| 5,709,775 | A | 1/1998 | Trokhan et al. | |
| 5,776,312 | A | 7/1998 | Trokhan et al. | |
| 5,804,036 | A | 9/1998 | Phan et al. | |
| 5,820,730 | A | 10/1998 | Phan et al. | |
| 5,830,321 | A | 11/1998 | Lindsay et al. | |
| 5,837,103 | A | 11/1998 | Trokhan et al. | |
| 5,840,403 | A | 11/1998 | Trokhan et al. | |
| 5,843,279 | A | 12/1998 | Phan et al. | |
| 5,846,379 | A | 12/1998 | Ampulski et al. | |
| 5,855,739 | A | 1/1999 | Ampulski et al. | |
| 5,871,887 | A | 2/1999 | Trokhan et al. | |
| 5,872,181 | A | 2/1999 | Daniels et al. | |
| 5,877,239 | A | 3/1999 | Craun et al. | |
| 5,885,418 | A * | 3/1999 | Anderson et al. | 162/112 |
| 5,893,965 | A | 4/1999 | Trokhan et al. | |
| 5,897,745 | A | 4/1999 | Ampulski et al. | |
| 5,904,811 | A | 5/1999 | Ampulski et al. | |
| 5,906,710 | A | 5/1999 | Trokhan | |
| 5,908,889 | A | 6/1999 | Bailey et al. | |
| 5,919,556 | A | 7/1999 | Barnholtz | |
| 5,935,381 | A | 8/1999 | Trokhan et al. | |
| 5,948,210 | A | 9/1999 | Huston | |
| 5,989,682 | A | 11/1999 | Anderson | |
| 5,990,377 | A | 11/1999 | Chen et al. | |
| 6,017,417 | A | 1/2000 | Wendt et al. | |
| 6,039,839 | A | 3/2000 | Trokhan et al. | |
| 6,054,020 | A | 4/2000 | Goulet et al. | |
| 6,059,928 | A | 5/2000 | Van Luu et al. | |
| 6,063,449 | A | 5/2000 | Koskinen et al. | |
| 6,083,346 | A | 7/2000 | Hermans et al. | |
| 6,096,152 | A | 8/2000 | Anderson et al. | |
| 6,096,169 | A | 8/2000 | Hermans et al. | |
| 6,103,062 | A | 8/2000 | Ampulski et al. | |
| 6,103,861 | A | 8/2000 | Staib et al. | |
| 6,117,270 | A | 9/2000 | Trokhan | |
| 6,117,492 | A | 9/2000 | Goldstein et al. | |
| 6,120,642 | A | 9/2000 | Lindsay et al. | |
| 6,126,784 | A | 10/2000 | Ficke et al. | |
| 6,129,815 | A * | 10/2000 | Larson et al. | 162/112 |
| 6,136,146 | A | 10/2000 | Phan et al. | |
| 6,140,419 | A | 10/2000 | Barglik-Chory et al. | |
| 6,143,135 | A | 11/2000 | Hada et al. | |
| 6,179,961 | B1 * | 1/2001 | Ficke et al. | 162/127 |
| 6,187,137 | B1 | 2/2001 | Druecke et al. | |
| 6,187,139 | B1 | 2/2001 | Edwards et al. | |
| 6,187,140 | B1 | 2/2001 | Anderson et al. | |
| 6,193,847 | B1 | 2/2001 | Trokhan | |
| 6,197,154 | B1 | 3/2001 | Chen et al. | |
| 6,200,418 | B1 | 3/2001 | Oriaran et al. | |
| 6,200,419 | B1 | 3/2001 | Phan | |
| 6,228,216 | B1 | 5/2001 | Lindsay et al. | |
| 6,303,672 | B1 | 10/2001 | Papalos et al. | |
| 6,309,527 | B1 | 10/2001 | Broekhuis et al. | |
| 6,319,312 | B1 | 11/2001 | Luongo | |
| 6,387,989 | B1 | 5/2002 | Sulzbach et al. | |
| 6,395,957 | B1 | 5/2002 | Chen et al. | |
| 6,410,617 | B1 | 6/2002 | Sulzbach et al. | |
| 6,420,013 | B1 | 7/2002 | Vinson et al. | |
| 6,423,180 | B1 | 7/2002 | Behnke et al. | |
| 6,426,121 | B1 | 7/2002 | Goldstein et al. | |
| 6,462,159 | B1 | 10/2002 | Hamada et al. | |
| 6,464,831 | B1 | 10/2002 | Trokhan et al. | |
| 6,465,556 | B1 | 10/2002 | Pratt et al. | |
| 6,500,289 | B2 | 12/2002 | Merker et al. | |
| 6,506,696 | B2 | 1/2003 | Goldstein et al. | |
| 6,506,821 | B1 | 1/2003 | Huver et al. | |
| 6,533,978 | B1 | 3/2003 | Wisneski et al. | |
| 6,534,151 | B2 * | 3/2003 | Merker | 428/154 |
| 6,534,177 | B2 | 3/2003 | Kohlhammer et al. | |
| 6,576,091 | B1 | 6/2003 | Cabell et al. | |
| 6,586,520 | B1 | 7/2003 | Canorro et al. | |
| 6,607,630 | B2 | 8/2003 | Bartman et al. | |
| 6,608,237 | B1 | 8/2003 | Li et al. | |
| 6,610,173 | B1 | 8/2003 | Lindsay et al. | |
| 6,660,362 | B1 | 12/2003 | Lindsay et al. | |
| 6,727,004 | B2 * | 4/2004 | Goulet et al. | 428/532 |
| 6,846,383 | B2 * | 1/2005 | Tirimacco | 162/111 |
| 6,918,993 | B2 * | 7/2005 | Tirimacco | 162/111 |
| 6,936,316 | B2 | 8/2005 | Nigam et al. | |
| 7,045,026 | B2 | 5/2006 | Lorenz et al. | |
| 2001/0005529 | A1 | 6/2001 | Owens et al. | |
| 2002/0107495 | A1 | 8/2002 | Chen et al. | |
| 2002/0117280 | A1 | 8/2002 | Howle et al. | |
| 2003/0079847 | A1 | 5/2003 | Howle et al. | |
| 2003/0121627 | A1 | 7/2003 | Hu et al. | |
| 2004/0007339 | A1 | 1/2004 | Tirimacco | |
| 2004/0018369 | A1 * | 1/2004 | Goulet et al. | 428/535 |
| 2004/0031578 | A1 | 2/2004 | Tirimacco | |
| 2004/0086726 | A1 * | 5/2004 | Moline et al. | 428/447 |
| 2004/0099388 | A1 | 5/2004 | Chen et al. | |
| 2004/0118531 | A1 * | 6/2004 | Shannon et al. | 162/109 |
| 2004/0118532 | A1 * | 6/2004 | Sarbo et al. | 162/109 |
| 2004/0118544 | A1 | 6/2004 | Tirimacco et al. | |
| 2004/0123963 | A1 | 7/2004 | Chen et al. | |
| 2004/0192136 | A1 | 9/2004 | Gusky et al. | |
| 2005/0004309 | A1 | 1/2005 | Gerst et al. | |
| 2005/0045292 | A1 | 3/2005 | Lindsay et al. | |
| 2005/0045293 | A1 * | 3/2005 | Hermans et al. | 162/109 |
| 2005/0045294 | A1 | 3/2005 | Goulet et al. | |
| 2006/0124261 | A1 | 6/2006 | Lindsay et al. | |
| 2007/0010153 | A1 * | 1/2007 | Shaffer et al. | 442/304 |
| 2007/0051484 | A1 * | 3/2007 | Hermans et al. | 162/109 |
| 2007/0102127 | A1 * | 5/2007 | Hermans et al. | 162/118 |

2008/0035288 A1 * 2/2008 Mullally et al. ..... 162/109

FOREIGN PATENT DOCUMENTS

| | | | |
|---|---|---|---|
| DE | 43 05 727 | A1 | 9/1994 |
| EP | 0 135 231 | A1 | 3/1985 |
| EP | 0 140 404 | A1 | 5/1985 |
| EP | 0 618 005 | A2 | 10/1994 |
| EP | 0 662 542 | A1 | 7/1995 |
| EP | 0 549 925 | B1 | 8/1995 |
| EP | 0 694 578 | A2 | 1/1996 |
| EP | 0 661 030 | B1 | 7/2000 |
| EP | 1 180 559 | A1 | 2/2002 |
| EP | 1 082 391 | B1 | 6/2002 |
| EP | 1 316 432 | A1 | 6/2003 |
| GB | 2 006 296 | A | 5/1979 |
| GB | 2 303 647 | A | 2/1997 |
| WO | WO 92/016681 | A1 | 10/1992 |
| WO | WO 93/010732 | A1 | 6/1993 |
| WO | WO 97/044528 | A1 | 11/1997 |
| WO | WO 97/047227 | A1 | 12/1997 |
| WO | WO 98/037274 | A1 | 8/1998 |
| WO | WO 98/055695 | A1 | 12/1998 |
| WO | WO 99/010597 | A1 | 3/1999 |
| WO | WO 99/034057 | A1 | 7/1999 |
| WO | WO 99/034060 | A1 | 7/1999 |
| WO | WO 00/008077 | A1 | 2/2000 |
| WO | WO 00/066835 | A1 | 11/2000 |
| WO | WO 01/002644 | A1 | 1/2001 |
| WO | WO 0114641 | A1 * | 3/2001 |
| WO | WO 02/029154 | A1 | 4/2002 |
| WO | WO 02/041815 | A2 | 5/2002 |
| WO | WO 02/100032 | A1 | 12/2002 |
| WO | WO 2004/005039 | A1 | 1/2004 |
| WO | WO 2004/009905 | A1 | 1/2004 |
| WO | WO 2004/037935 | A1 | 5/2004 |
| WO | WO 2005021868 | A1 * | 3/2005 |

OTHER PUBLICATIONS

American Society for Testing Materials (ASTM) Designation: D1544-98, "Standard Test Method for Color of Transparent Liquids (Gardner Color Scale),"pp. 1-2, published Sep. 1998.

American Society for Testing Materials (ASTM) Designation: D5170-98, "Standard Test Method for Peel Strength ('T' Method) of Hook and Loop Touch Fasteners," pp. 702-704, published Mar. 1999.

Bhangale, Sunil M., "Epoxy Resins," Internet web page "http://sunilbhangale.tripod.com/epoxy.html", viewed and printed Jul. 29, 2003, pp. 1-4.

Blank, Werner J. et al., "Catalysis of the Epoxy-Carboxyl Reaction," *International Waterborne, High-Solids and Powder Coatings Symposium,* New Orleans, LA, Feb. 21-23, 2001, sponsored by the University of Southern Mississippi, Paper23_lct1.doc, printed Aug. 8, 2001, 18 pages.

Carey, Francise A., "Reactions of Epoxides," *Organic Chemistry 4e Carey Online Learning Center,* Chapter 16: Ethers, Epoxides and Sulfides, McGraw Hill, 2000, Internet web page, "http://www.mhhe.com/physsci/chemistry/carey/student/olc/ch16reactionsepoxides.html", viewed and printed Jul. 29, 2003, pp. 1-4.

Day, Dr. Richard, "Epoxy Resins," Internet web page, 37 http://www2.umist.ac.uk/material/teaching/year2/ml260/epoxy.doc", Feb. 26, 1998, viewed and printed Jul. 29, 2003, 10 pages.

DeVry, William E., "Latex Bonding Chemistry and Processes," *Nonwovens An Advanced Tutorial,* edited by Albin F. Turbak and Tyrone L. Vigo, TAPPI Press, Atlanta, GA, 1989, Chapter 5, pp. 51-69.

Donnelly, R.H. and Martti Kangas, "Dryad Technology—Implementing Spraying Technology in Paper and Boarding Manufacturing," *Paperi ia Puu—Paper and Timber,* vol. 83, No. 7, 2001, pp. 530-531.

Espy, Herbert H., "Alkaline-Curing Polymeric Amine-Epichlorohydrin Resins,"*Wet-Strength Resins and Their Application,* edited by Lock L. Chan, Chapter 2, TAPPI Press, Atlanta, GA, 1994, pp. 14-44.

"Glycidylic Ethers," KEMI, National Chemicals Inspectorate, Sweden, Internet web page "http://www.kemi.se/kemamne_eng/glycldetar_eng.htm", viewed and printed Jul. 29, 2003, pp. 1-2.

Moyer, W.W. Jr. and R.A. Stagg, "Miscellaneous Wet-Strength Agents," *Wet Strength in Paper and Paperboard,* TAPPI Monograph Series No. 29, Technical Association of the Pulp and Paper Industry, Mack Printing Company, Easton, PA, Chapter 8, 1965, pp. 105-125.

Oinonen, Hannu, "Metso Introduces New Coating Method: Spray for Light-Weight Coating," *Paperi ja Puu—Paper and Timber,* vol. 83, No. 7, 2001, pp. 526-528.

Sabia, A.J. and R.B. Metzler, "The Role of Silicones In Woven and Nonwoven Fabric Applications," *Advances in Nonwoven Technology-Tenth Technical Symposium,* Inda, Association of the Nonwoven Fabrics Industry, New York, Nov. 17-19, 1982, pp. 284-293.

Zhao, Yaqiu and Marek W. Urban, "Novel STY/nBA/GMA and STY/nBA/MAA Core-Shell Latex Blends: Film Formation, Particle Morphology, and Cross-Linking. 20. A Spectroscopic Study," *Macromolecules,* vol. 33, No. 22, 2000. pp. 8426-8434.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

* cited by examiner

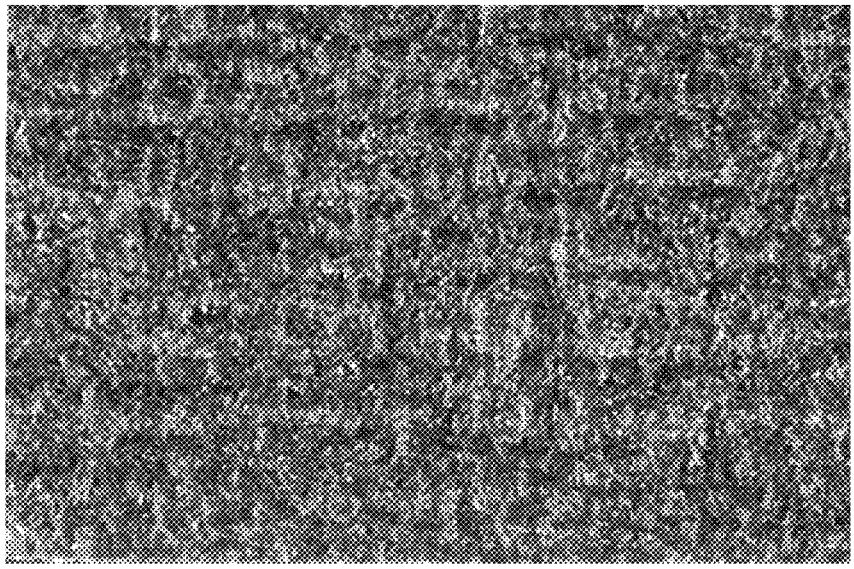
FIG. 3
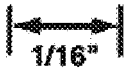
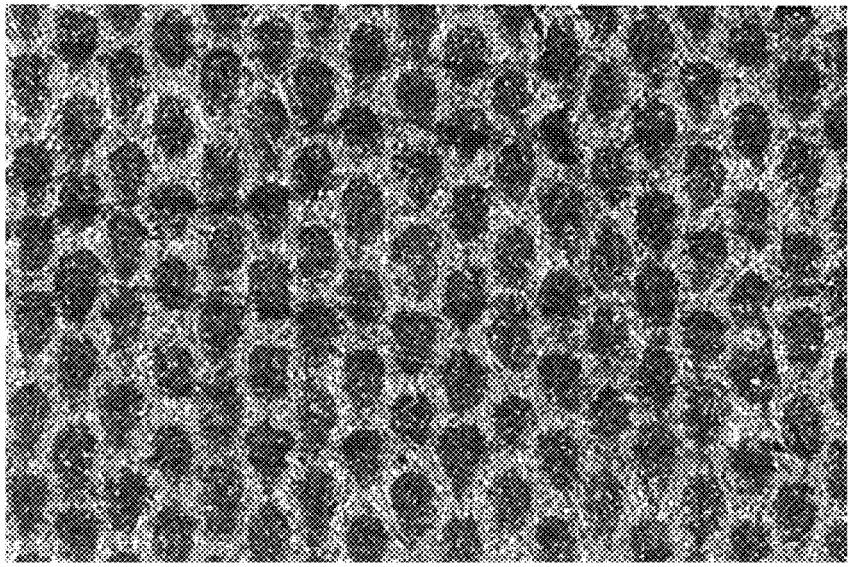
FIG. 4
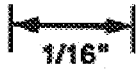

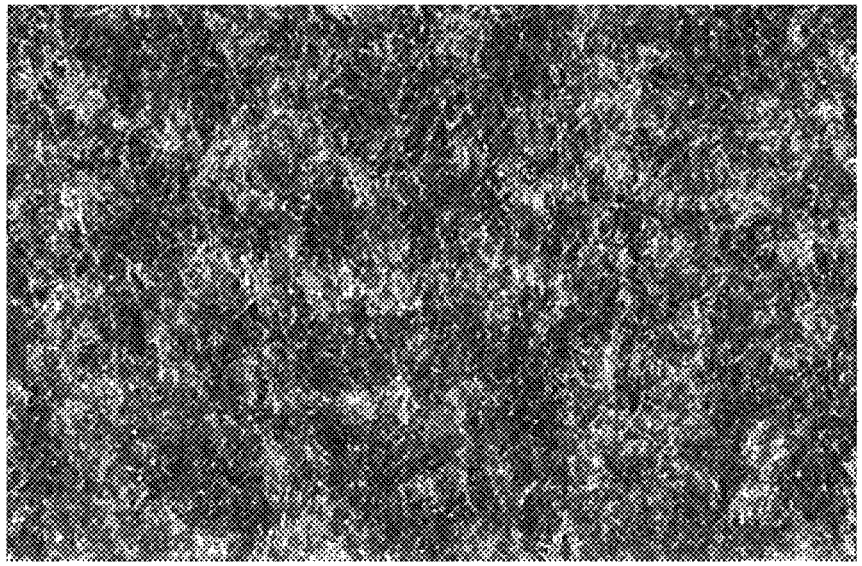
FIG. 6
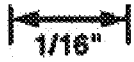
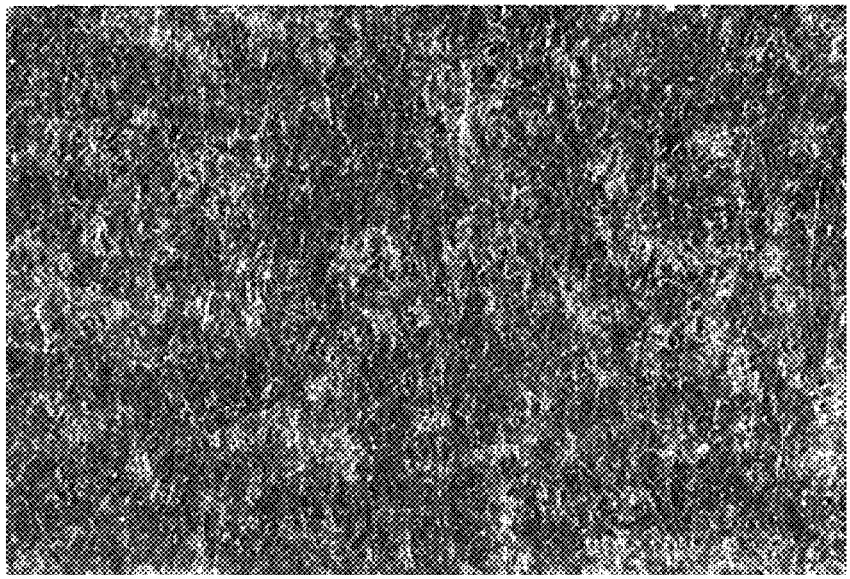
FIG. 7
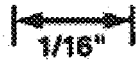

PAPER SHEET HAVING HIGH ABSORBENT CAPACITY AND DELAYED WET-OUT

This application is a divisional application of U.S. Ser. No. 10/654,286 filed Sep. 2, 2003 now abandoned. The entirety of U.S. Ser. No. 10/654,286 is incorporated herein by reference.

BACKGROUND OF THE INVENTION

Manufacturers of paper towels continually strive to improve the absorbent characteristics of the product. For cleaning up spills, the user frequently wants a high absorbent capacity and a high absorbent rate. However, for some uses, the users want a more moderate rate of absorbency (delayed wet-out time) in order to protect their hands from being wetted. At the same time, they still require a high absorbent capacity and other desirable properties such as wet strength and hand feel.

SUMMARY OF THE INVENTION

It has now been discovered that the absorbent characteristics of an absorbent sheet, such as can be used for a single-ply paper towel or multi-ply paper towel or the like, can be improved by providing the surface of the sheet with an intermittent or discontinuous moisture retardant coating, such as can be provided by suitable application of a latex binder, that appropriately retards the rate of absorption while maintaining a high absorbent capacity provided by the void volume of the interior structure. The sheet can be any sheet having a highly debonded (low density) interior structure, such as a wet-laid paper sheet (particularly a creped throughdried or uncreped throughdried sheet) or an air-laid sheet. To be most effective, the moisture retardant coating should cover a significant portion of the surface of the sheet to partially block moisture (liquid) penetration and maintain adequate wet strength properties. At the same time, the coating must leave a sufficient amount of uncoated area for liquid passage into the interior of the sheet in order to allow the sheet to simultaneously exhibit high absorbent capacity. A convenient method of further enhancing the absorbent capacity of the sheet is to crepe the moisture retardant coating-treated surface of the sheet, thereby modifying the pore structure and increasing the void volume within the center of the sheet where the moisture retardant coating has not penetrated or otherwise does not reside. In this regard, it is advantageous to limit the application of the moisture retardant coating to the surface or near surface region of the sheet.

Hence in one aspect, the invention resides in a method of making a low density absorbent paper sheet comprising: (a) producing a low density basesheet of papermaking fibers having a basis weight of from about 30 to about 90 gsm; (b) applying a moisture retardant coating to one side of the sheet in a discontinuous or spaced-apart pattern covering from about 10 to about 70 percent of the surface area of that side and drying the moisture retardant coating; (c) applying a moisture retardant coating to the opposite side of the sheet in a discontinuous or spaced-apart pattern covering from about 10 to about 70 percent of the surface area of that side and drying the moisture retardant coating; and (d) creping at least one side of the sheet after the moisture retardant coating has been applied and dried, wherein the resulting sheet has a Vertical Absorbent Capacity of 6.0 grams of water or greater per gram of fiber and a Wet-Out Time of 3.5 seconds or greater.

For purposes herein, a "low density" basesheet or sheet is one having a Bulk of 8 cubic centimeters or greater per gram as measured as described below. Particularly included are basesheets or sheets of product produced by throughdried methods (creped or uncreped) and air-laid methods. Such basesheets and sheets have the desirable open pore structure and internal void volume necessary for a high absorbent capacity. The basesheets or products of this invention can have Bulk values of 8 cubic centimeters or greater per gram, more specifically about 9 cubic centimeters or greater per gram, more specifically about 10 cubic centimeters or greater per gram, more specifically from about 8 to about 12 cubic centimeters per gram, and still more specifically from about 9 to about 12 cubic centimeters per gram.

In another aspect, the invention resides in an absorbent paper product having one or more plies, such as can be suitable for use as a single-ply or multi-ply tissue or paper towel, said product having a Vertical Absorbent Capacity (hereinafter defined) of about 6.0 grams of water or greater per gram of fiber and a Wet-Out Time (hereinafter defined) of 3.5 seconds or greater. As used herein, the term "product" means the final end-use product, which will include one or more sheets.

In another aspect, the invention resides in a paper product having one or more sheets (plies) which can be suitable for use as a single-ply or multi-ply tissues, paper towels or table napkins, wherein at least one outer surface of the product has a spaced-apart pattern of a moisture retardant coating which covers from about 30 to about 60 percent of the area of the surface, said product having a Vertical Absorbent Capacity of 6.0 grams of water or greater per gram of fiber and a Wet-Out Time of 3.5 seconds or greater.

In these and other various aspects of this invention, the Vertical Absorbent Capacity of the product (a single-ply or multi-ply product) can be about 6.0 grams of water or greater per gram of fiber, more specifically about 7.0 grams of water or greater per gram of fiber, more specifically about 8.0 grams of water or greater per gram of fiber, more specifically about 9.0 grams of water or greater per gram of fiber, more specifically from about 7.0 to about 12 grams of water per gram of fiber, still more specifically from about 8.0 to about 12 grams of water per gram of fiber, and still more specifically from about 9.0 to about 12 grams of water per gram of fiber.

In the various aspects of the invention, the Wet-Out Time can be 3.5 seconds or greater, more specifically about 4.0 seconds or greater, more specifically from 3.5 to about 8 seconds, more specifically from 3.5 to about 7 seconds, and still more specifically from about 4.5 to about 7 seconds. Without being limited by theory, factors which increase the Wet-Out Time include: increasing the surface area coverage of the moisture retardant coating; using a hydrophobic moisture retardant coating material; increasing the hydrophobic nature of the moisture retardant coating material (for example, by incorporating hydrophobic binder additives); enlarging the pore size of the pores within the sheet or plies; and increasing the basis weight of the sheet or plies.

The surface area coverage of the moisture retardant coating is discontinuous in the sense that it is not a solid film in order to allow liquid or moisture to penetrate into the sheet. It can be present in the form of a regularly or irregularly spaced-apart pattern of uniform or non-uniform deposits, such as provided by printing or a thinly-applied spray, for example. For each of the two outer surfaces of the product, the percent surface area coverage of the moisture retardant coating, as projected in a plan view of the surface, can be from about 10 to about 70 percent, more specifically from about 10 to about 60 percent, more specifically from about 15 to about 60 percent, more specifically from about 20 to about 60 percent, and still more specifically from about 25 to about 50 percent. The surface area coverage of each outer surface can be the same or different. As used herein, "surface area coverage" refers to the percent of the total area covered by the moisture retardant coating when measuring at least 6 square inches of the web.

For a given total amount of moisture retardant coating, increasing the amount of the moisture retardant coating on the side of the product exposed to moisture will increase the Wet-Out time relative to a similar product with equal amounts of the coating on each side. However, since both sides of the product may be used, it is advantageous to apply the moisture retardant coating to both sides of the sheet. In most cases, a moisture retardant coating application add-on split of 3:1 or less (no more than 75% of the total moisture retardant coating is applied on one side of the product) is suitable.

Additionally, for some multi-ply products, it is not necessary that the application of the moisture retardant coating be limited to an outer surface. For example, for a multi-ply product having three or more plies, the moisture retardant coating can be applied to one or more surfaces of an inner ply and still achieve the desirable results. Alternatively, the moisture retardant coating can be applied to an inner surface of either or both outer plies. This arrangement would not reduce the absorbent rate for minor amounts of liquid, since the outer surfaces of the product would be free or substantially free of the moisture retardant coating, but for larger insults the penetration delay would still be present.

The total add-on amount of the moisture retardant coating, based on the weight of the product, can be about 2 weight percent or more, more specifically from about 2 to about 20 dry weight percent, more specifically from about 4 to about 9 dry weight percent, still more specifically from about 5 to about 8 dry weight percent. The add-on amount can be affected by the desired surface area coverage and the penetration depth of the deposits. The add-on amount applied to each outer surface of the product can be the same or different. The moisture retardant coating applied to different sheet surfaces can be the same or different.

Suitable moisture retardant coatings include, without limitation, latex binder materials such as acrylates, vinyl acetates, vinyl chlorides and methacrylates and the like. The latex materials may be created or blended with any suitable cross-linker, such as N-Methylolacrylamide (NMA), or may be free of cross-linkers. Particular examples of latex binder materials that can be used in the present invention include AIRFLEX® EN1165 available from Air Products Inc. or ELITE® PE BINDER available from National Starch. It is believed that both of the foregoing binder materials are ethylene vinyl acetate copolymers. Other suitable moisture retardant coatings include, without limitation, carboxylated ethylene vinyl acetate terpolymer; acrylics; polyvinyl chloride; styrene-butadiene; polyurethanes; silicone materials, such as curable silicone resins, organoreactive polysiloxanes and other derivatives of polydimethylsiloxane; fluoropolymers, such as tetrafluoroethylene; hydrophobic coacervates or coplexes of anionic and cationic polymers, such as complexes of polyvinylamines and polycarboxylic acids; polyolefins and emulsions or compounds thereof; and many other film-forming compounds known in the art, as well as modified versions of the foregoing materials. The moisture retardant coating materials can be substantially latex-free or substantially natural latex-free in some embodiments.

The number of plies or sheets in the products of this invention can be one, two, three, four, five or more. For economy, single-ply or two-ply products are advantageous. The various plies within any given multi-ply product can be the same or different. By way of example, the various plies can contain different fibers, different chemicals, different basis weights, or be made differently to impart different topography or pore structure. As previously mentioned, different processes include throughdrying (creped or uncreped), air-laying and wet-pressing (including modified wet-pressing). Wet-molded throughdried plies, such as uncreped throughdried plies, have been found to be particularly advantageous because of their wet resiliency and three-dimensional topography. Furthermore, the sheets can be apertured, slit, embossed, laminated with adhesive means to similar or different layers, crimped, perforated, etc., and that it can comprise skin care additives, odor control agents, antimicrobials, perfumes, dyes, mineral fillers, and the like.

The fibers used to form the sheets or plies useful for purposes of this invention can be substantially entirely hardwood kraft or softwood kraft fibers, or blends thereof. However, other fibers can also be used for part of the furnish, such as sulfite pulp, mechanical pulp fibers, bleached chemithermomechanical pulp (BCTMP) fibers, synthetic fibers, precrosslinked fibers, non-woody plant fibers, and the like. More specifically, by way of example, the fibers can be from about 50 to about 100 percent softwood kraft fibers, more specifically from about 60 to about 100 percent softwood kraft fibers, still more specifically from about 70 to about 100 percent softwood kraft fibers, still more specifically from about 80 to about 100 percent softwood kraft fibers, and still more specifically from about 90 to about 100 percent softwood kraft fibers.

The basis weight of the products of this invention, whether single-ply or multiple-ply, can be from about 30 to about 90 gsm (grams per square meter), more specifically from about 40 to about 80 gsm, still more specifically from about 45 to about 75 gsm, and still more specifically from about 50 to about 70 gsm.

The tensile strengths of the products of this invention, which are expressed as the geometric mean tensile strength, can be from about 500 grams per 3 inches of width to about 3000 grams or more per 3 inches of width depending on the intended use of the product. For paper towels, a preferred embodiment of this invention, geometric mean tensile strengths of about 1000-2000 grams per 3 inches are preferred. The ratio of the machine direction tensile strength to the cross-machine direction tensile strength can vary from about 1:1 to about 4:1.

As used herein, dry machine direction (MD) tensile strengths represent the peak load per sample width when a sample is pulled to rupture in the machine direction. In comparison, dry cross-machine direction (CD) tensile strengths represent the peak load per sample width when a sample is pulled to rupture in the cross-machine direction. Samples for tensile strength testing are prepared by cutting a 3 inches (76.2 mm) wide×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load is recorded as either the "MD dry tensile strength" or the "CD dry tensile strength" of the specimen depending on the sample being tested. At least six (6) representative specimens are tested for each product and the arithmetic average of all individual specimen tests is either the MD or CD tensile strength for the product.

As used herein, "Vertical Absorbent Capacity" is a measure of the amount of water absorbed by a paper product (single-ply or multi-ply) or a sheet, expressed as grams of water absorbed per gram of fiber (dry weight). In particular, the Vertical Absorbent Capacity is determined by cutting a sheet of the product to be tested (which may contain one or more plies) into a square measuring 100 millimeters by 100 millimeters (±1 mm.) The resulting test specimen is weighed to the nearest 0.01 gram and the value is recorded as the "dry weight". The specimen is attached to a 3-point clamping device and hung from one corner in a 3-point clamping device such that the opposite corner is lower than the rest of the specimen, then the sample and the clamp are placed into a dish of water and soaked in the water for 3 minutes (±5 seconds). The water should be distilled or de-ionized water at a temperature of 23±3° C. At the end of the soaking time, the specimen and the clamp are removed from the water. The clamping device should be such that the clamp area and pressure have minimal effect on the test result. Specifically, the clamp area should be only large enough to hold the sample and the pressure should also just be sufficient for holding the sample, while minimizing the amount of water removed from the sample during clamping. The sample specimen is allowed to drain for 3 minutes (±5 seconds). At the end of the draining time, the specimen is removed by holding a weighing dish under the specimen and releasing it from the clamping device. The wet specimen is then weighed to the nearest 0.01 gram and the value recorded as the "wet weight". The Vertical Absorbent Capacity in grams per gram=[(wet weight−dry weight)/dry weight]. At least five (5) replicate measurements are made on representative samples from the same roll or box of product to yield an average Vertical Absorbent Capacity value.

As used herein, "Wet-Out Time" is a measure of how fast the paper product absorbs water and reaches its absorbent capacity, expressed in seconds. In particular, the Wet-Out Time is determined by selecting and cutting 20 representative sheets of product (single-ply or multi-ply) into squares measuring 63×63 mm (±3 mm) and stacking them one on top of the other. The resulting pad of 20 product sheets is stapled together, using a standard office staple with a size no larger than necessary to secure the sheets, across each corner of the test pad just far enough from the edges to hold the staples. The staples should be oriented diagonally across each corner and should not wrap around the edges of the test pad. With the staple points facing down, the pad is held horizontally over a pan of distilled or de-ionized water having a temperature of 23±3° C., approximately 25 millimeters from the surface of the water. The pad is dropped flat onto the surface of the water and the time for the pad to become visually completely saturated with water is recorded. This time, measured to the nearest 0.1 second, is the Wet-Out Time for the sample. At least five (5) representative samples of the same product are measured to yield an average Wet-Out Time value, which is the Wet-Out Time for the product.

As used herein, the parameter "Bulk" or "Stack Bulk" is calculated as the quotient of the Caliper (hereinafter defined) of a product, expressed in microns, divided by the basis weight, expressed in grams per square meter. The resulting Bulk of the product is expressed in cubic centimeters per gram. Caliper is measured as the total thickness of a stack of ten representative sheets of product and dividing the total thickness of the stack by ten, where each sheet within the stack is placed with the same side up. Caliper is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second. After the Caliper is measured, the top sheet of the stack of 10 is removed and the remaining sheets are used to determine the basis weight.

Basis weight is the weight of a specified area of material expressed in grams per square meter. Basis weight can be described as "air dry", which refers to material that has not been conditioned and contains an unknown amount of moisture depending on the ambient conditions, or as "bone dry", which refers to material that is oven dried for a specific time prior to basis weight measurement being taken.

The method for determining the basis weight, expressed as grams per square meter (gsm), is as follows. A specimen size of 929.09±18.58 $cm^2$ is obtained by cutting 9 finished product sheets into 101.6×101.6 mm±1 mm. For the "air dry" basis weight, the stack is weighed and the weight is recorded in grams. To calculate the basis weight, this stack weight is then divided by the test area in square meters (i.e. 0.092909 $m^2$). For "bone dry" basis weight, a weighing container and lid are weighed. The sample is then placed in the uncovered container and the container with sample is placed in a 105±2° C. oven for an hour. After an hour, the lid is placed on the container and the container is removed from the oven and allowed to cool to approximately room temperature. The covered container with sample is then weighed and the weight of the container and lid are subtracted to determine the sample weight in grams. To calculate the basis weight, the sample weight is then divided by the test area in square meters (i.e. 0.092909 $m^2$).

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

FIG. 3 is a plan view color photograph of one side of the single-ply product of Example 1, illustrating the surface area coverage of the latex binder, which is shown in orange.

FIG. 4 is a plan view color photograph of the other side of the product of Example 1.

FIG. 6 is a plan view color photograph of one side of the single-ply product of Example 11, illustrating the surface area coverage of the latex binder.

FIG. 7 is a plan view color photograph of the other side of the product of Example 11.

DETAILED DESCRIPTION OF THE DRAWINGS

Figure 1A:
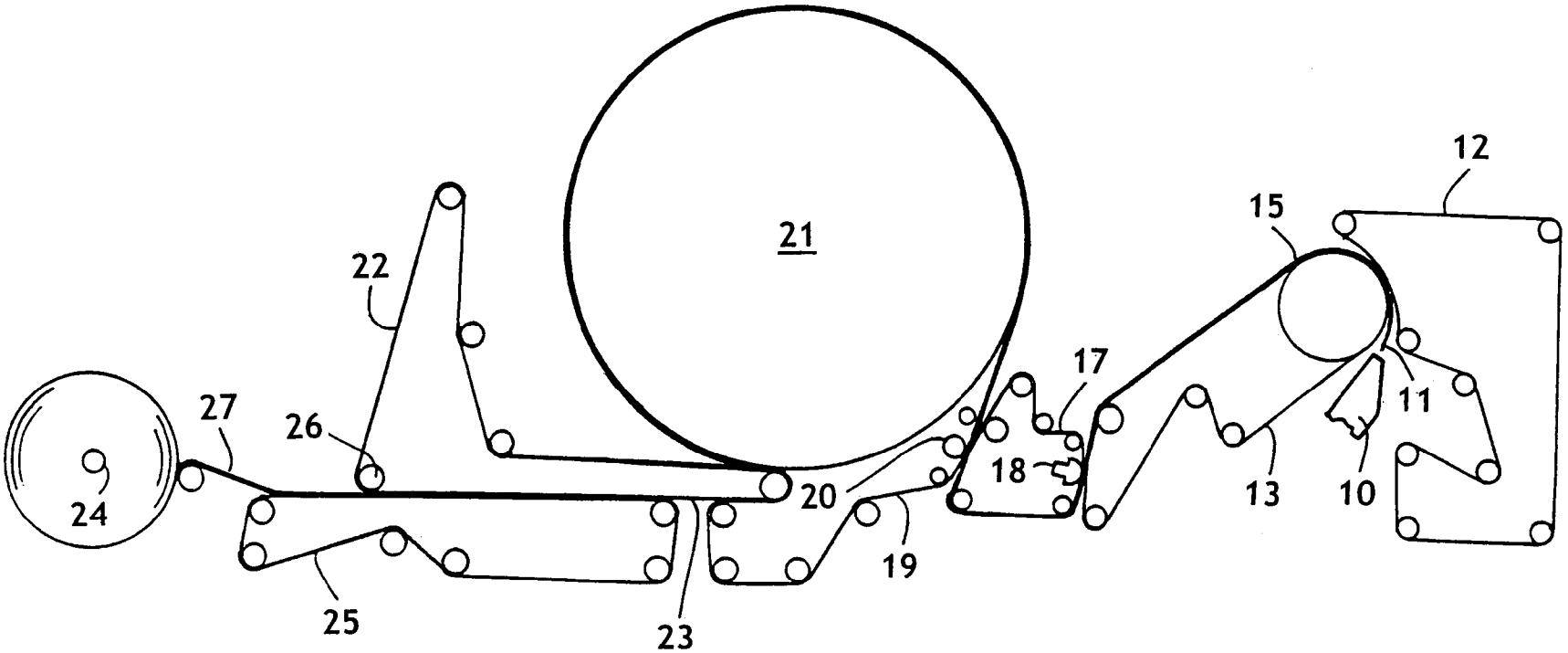
FIG. 1A is a schematic illustration of an uncreped through-dried paper making process suitable for purposes of making basesheet plies in accordance with this invention.

FIG. 1A is a schematic illustration of an uncreped throughdried process useful for making basesheets suitable for purposes of this invention. Shown is a twin wire former 8 having a papermaking headbox 10 which injects or deposits a stream 11 of an aqueous suspension of papermaking fibers onto a plurality of forming fabrics, such as the outer forming fabric 12 and the inner forming fabric 13, thereby forming a wet tissue web 15. The forming process of the present invention may be any conventional forming process known in the papermaking industry. Such formation processes include, but are not limited to, Fourdrinier formers, roof formers such as suction breast roll formers, and gap formers such as twin wire formers and crescent formers.

The wet tissue web 15 forms on the inner forming fabric 13 as the inner forming fabric 13 revolves about a forming roll 14. The inner forming fabric 13 serves to support and carry the newly-formed wet tissue web 15 downstream in the process as the wet tissue web 15 is partially dewatered to a consistency of about 10 percent based on the dry weight of the fibers. Additional dewatering of the wet tissue web 15 may be carried out by known paper making techniques, such as vacuum suction boxes, while the inner forming fabric 13 supports the wet tissue web 15. The wet tissue web 15 may be additionally dewatered to a consistency of at least about 20%, more specifically between about 20% to about 40%, and more specifically about 20% to about 30%. The wet tissue web 15 is then transferred from the inner forming fabric 13 to a transfer fabric 17 traveling preferably at a slower speed than the inner forming fabric 13 in order to impart increased MD stretch into the wet tissue web 15.

The wet tissue web 15 is then transferred from the transfer fabric 17 to a throughdrying fabric 19 whereby the wet tissue web 15 may be macroscopically rearranged to conform to the surface of the throughdrying fabric 19 with the aid of a vacuum transfer roll 20 or a vacuum transfer shoe like the vacuum shoe 18. If desired, the throughdrying fabric 19 can be run at a speed slower than the speed of the transfer fabric 17 to further enhance MD stretch of the resulting absorbent sheet. The transfer may be carried out with vacuum assistance to ensure conformation of the wet tissue web 15 to the topography of the throughdrying fabric 19.

While supported by the throughdrying fabric 19, the wet tissue web 15 is dried to a final consistency of about 94 percent or greater by a throughdryer 21 and is thereafter transferred to a carrier fabric 22. Alternatively, the drying process can be any non-compressive drying method that tends to preserve the bulk of the wet tissue web 15.

The dried tissue web 23 is transported to a reel 24 using a carrier fabric 22 and an optional carrier fabric 25. An optional pressurized turning roll 26 can be used to facilitate transfer of the dried tissue web 23 from the carrier fabric 22 to the carrier fabric 25. If desired, the dried tissue web 23 may additionally be embossed to produce a pattern on the absorbent tissue product produced using the throughdrying fabric 19 and a subsequent embossing stage.

Once the wet tissue web 15 has been non-compressively dried, thereby forming the dried tissue web 23, it is possible to crepe the dried tissue web 23 by transferring the dried tissue web 23 to a Yankee dryer prior to reeling, or using alternative foreshortening methods such as micro-creping as disclosed in U.S. Pat. No. 4,919,877 issued on Apr., 24, 1990 to Parsons et al., herein incorporated by reference.

In an alternative embodiment not shown, the wet tissue web 15 may be transferred directly from the inner forming fabric 13 to the throughdrying fabric 19, thereby eliminating the transfer fabric 17. The throughdrying fabric 19 may be traveling at a speed less than the inner forming fabric 13 such that the wet tissue web 15 is rush transferred or, in the alternative, the throughdrying fabric 19 may be traveling at substantially the same speed as the inner forming fabric 13.

Figure 1B:
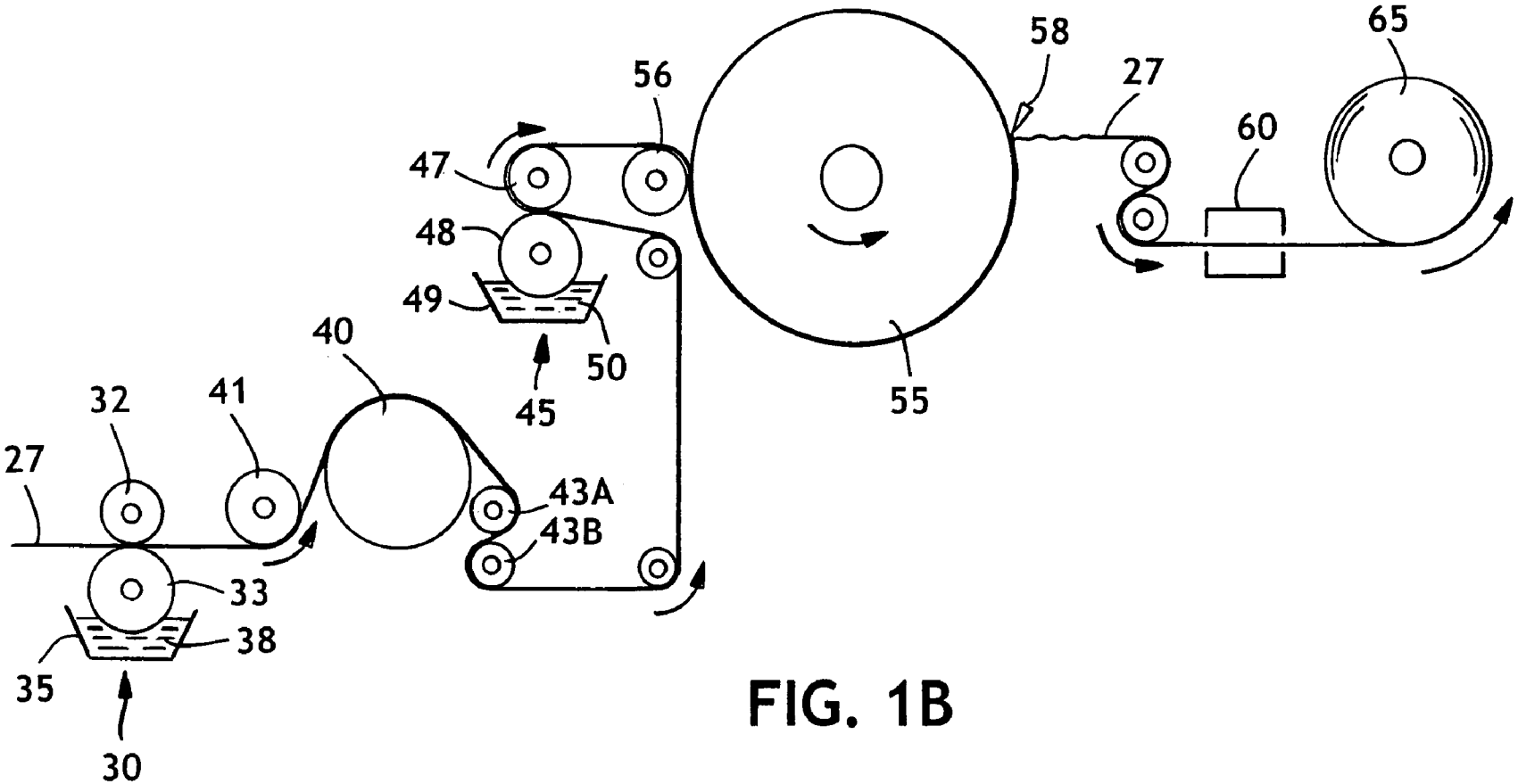
FIG. 1B is a schematic illustration of a method of applying binder to the basesheet made in accordance with the process of FIG. 1A.

FIG. 1B is a schematic representation of a process in which a latex binder is applied to the both outer surfaces of the uncreped throughdried basesheet as produced in accordance with FIG. 1. Although gravure printing of the moisture retardant material is illustrated, other means of applying the moisture retardant material can also be used, such as foam application or digital printing methods such as ink jet printing and the like. Shown is paper sheet 27 passing through a first moisture retardant application station 30. Station 30 includes a nip formed by a smooth rubber press roll 32 and a patterned rotogravure roll 33. Rotogravure roll 33 is in communication with a reservoir 35 containing a first moisture retardant material 38. Rotogravure roll 33 applies the moisture retardant material 38 to one side of sheet 27 in a pre-selected pattern.

Sheet 27 is then contacted with a heated roll 40 after passing a roll 41. The heated roll 40 is for partially drying the sheet after the application of the moisture barrier coating. The heated roll 40 can be heated to a temperature, for instance, up to about 250° F. and particularly from about 180° F. to about 220° F. In general, the sheet can be heated to a temperature sufficient to dry the sheet and evaporate any water. It should be understood, that the besides the heated roll 40, any suitable heating device can be used to dry the sheet. For example, in an alternative embodiment, the sheet can be placed in communication with an infra-red heater in order to dry the sheet. Besides using a heated roll or an infra-red heater, other heating devices can include, for instance, any suitable convective oven or microwave oven.

From the heated roll 40, the sheet 27 can be advanced by pull rolls 43A and 43B to a second moisture barrier material application station 45. Station 45 includes a transfer roll 47 in contact with a rotogravure roll 48, which is in communication with a reservoir 49 containing a second moisture barrier material 50, which can be the same or different than the moisture barrier material 38 applied at the first station 30. Similar to station 30, the second moisture barrier material 50 is applied to the opposite side of the sheet in a pre-selected pattern. After the second moisture barrier material is applied, the sheet is adhered to a creping roll 55 by a press roll 56. The sheet is carried on the surface of the creping drum for a distance and then removed therefrom by the action of a creping blade 58. The creping blade performs a controlled pattern creping operation on the second side of the sheet.

Once creped, the sheet 27 is pulled through an optional drying station 60. The drying station can include any form of a heating unit, such as an oven energized by infrared heat, microwave energy, hot air or the like. Alternatively, the drying station may comprise other drying methods such as photo-curing, UV-curing, corona discharge treatment, electron beam curing, curing with reactive gas, curing with heated air such as through-air heating or impingement jet heating, infrared heating, contact heating, inductive heating, microwave or RF heating, and the like. The drying station may be necessary in some applications to dry the sheet and/or cure the barrier coating materials. Depending upon the materials selected, however, drying station 60 may not be needed. Once passed through the drying station, the sheet can be wound into a roll of material or product 65.

Figure 1C:
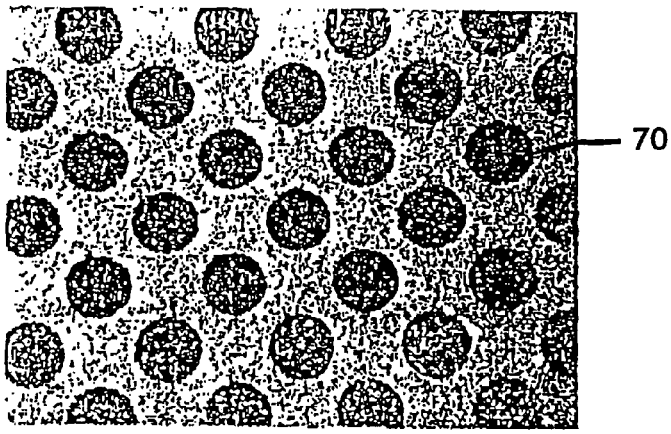
FIG. 1C is a representation of the binder pattern applied to one side of the basesheet.
Figure 1D:
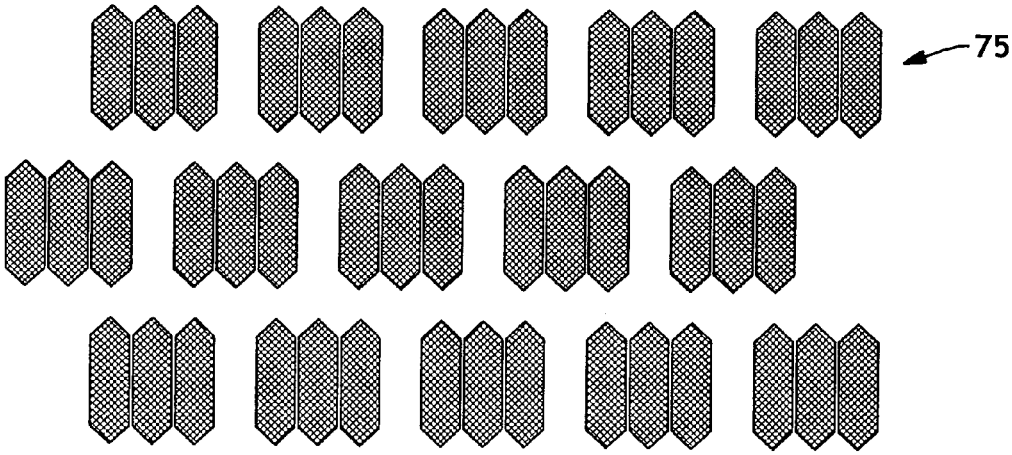
FIG. 1D is a representation of the binder pattern applied to the opposite side of the basesheet.

FIG. 1C shows one embodiment of a print pattern that can be used for applying a barrier coating material to a paper sheet in accordance with this invention. As illustrated, the pattern represents a succession of discrete dots 70. In one embodiment, for instance, the dots can be spaced so that there are approximately from about 25 to about 35 dots per inch in the machine direction and/or the cross-machine direction. The dots can have a diameter, for example, of from about 0.01 inches to about 0.03 inches. In one particular embodiment, the dots can have a diameter of about 0.02 inches and can be present in the pattern so that approximately 28 dots per inch extend in either the machine direction or the cross-machine direction. Besides dots, various other discrete shapes can also be used when printing the moisture barrier coating onto the sheet. For example, as shown in FIG. 1D, a print pattern is illustrated in which the moisture barrier print pattern is made up of discrete multiple deposits 75 that are each comprised of three elongated hexagons. In one embodiment, each hexagon can be about 0.02 inches long and can have a width of about 0.006 inches. Approximately 35 to 40 deposits per inch can be spaced in the machine direction and the cross-machine direction.

Figure 2A:
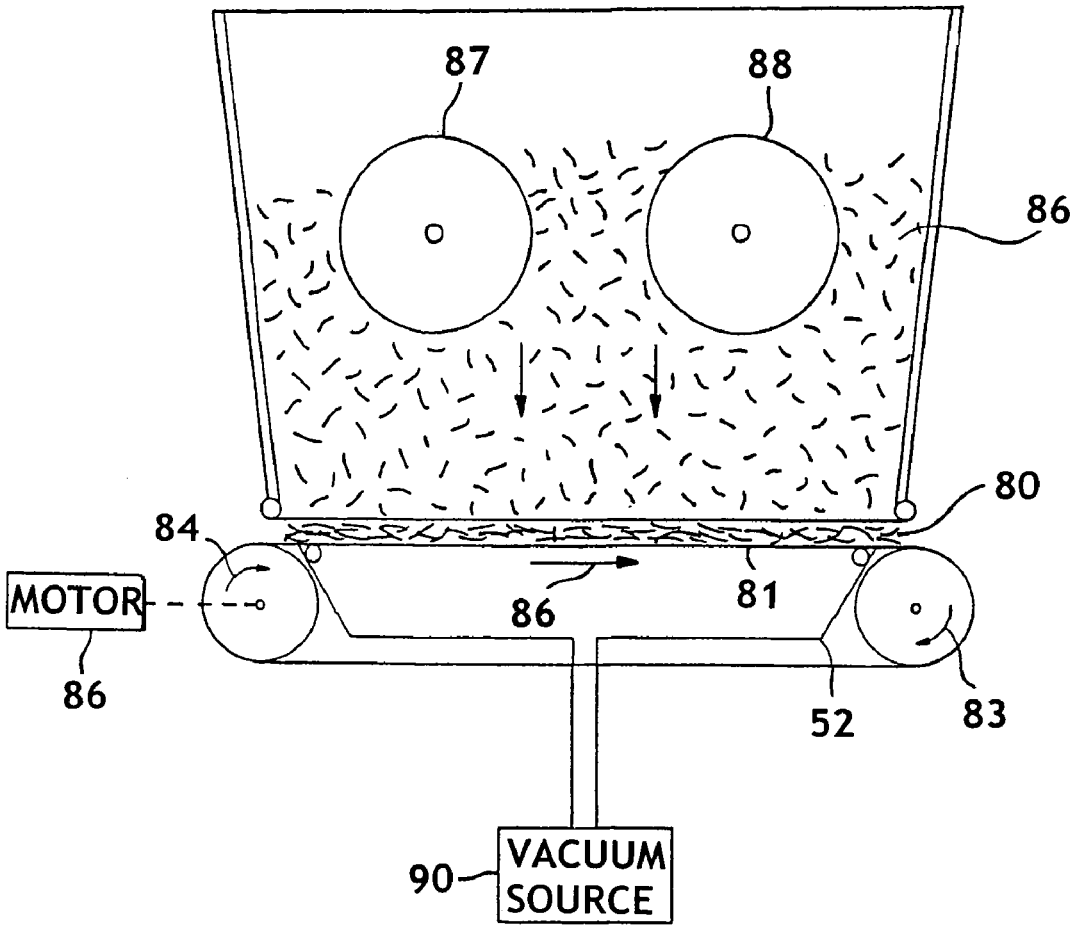
FIGS. 2A and 2B are schematic illustrations of an air-laid paper making process suitable for purposes of making basesheet plies in accordance with this invention.
Figure 2B:
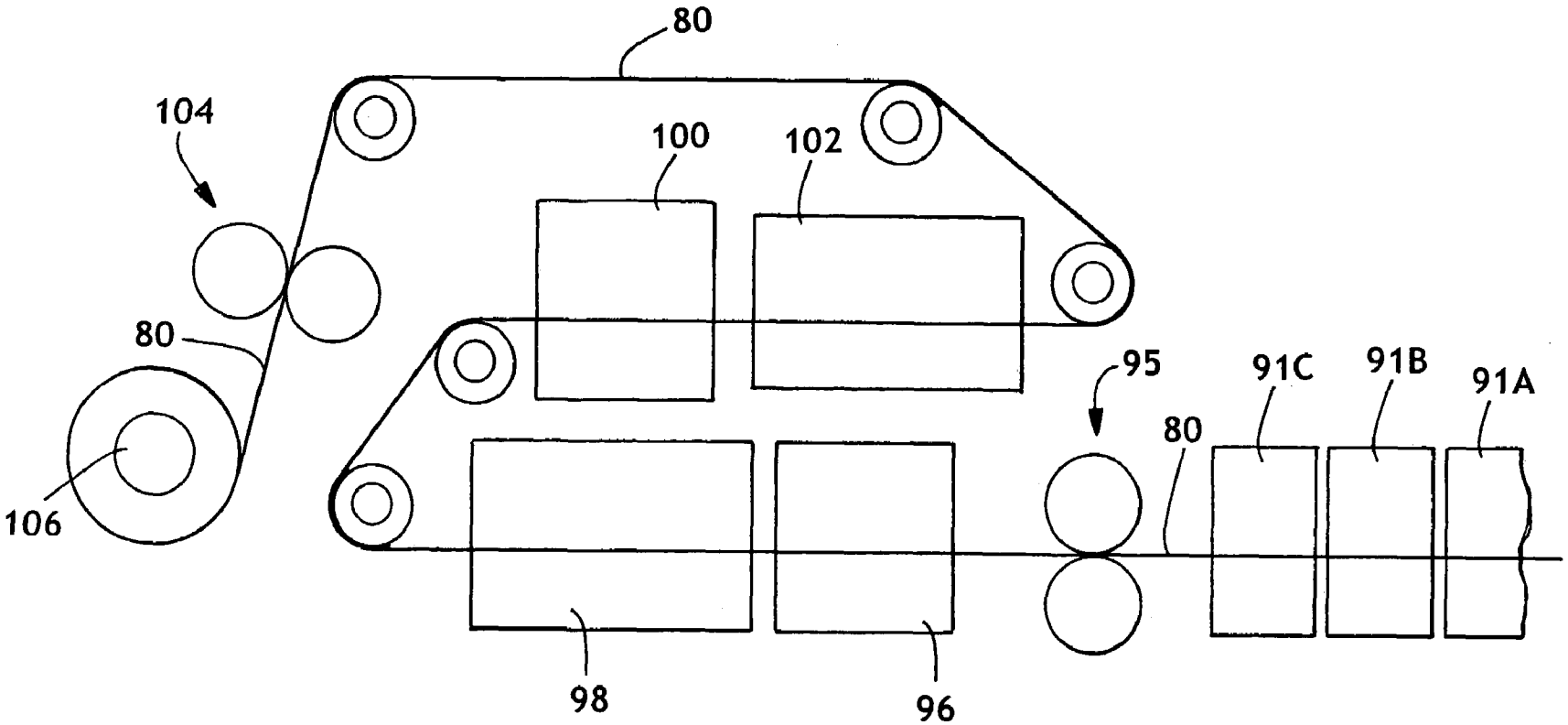

FIGS. 2A and 2B are schematic illustrations of an air-laid process useful for making basesheets and/or products in accordance with this invention. In an air-laid process, the moisture barrier material is also a binder, the application of which is typically integral with the process for making the basesheet. As such, a separate post-treatment process to apply the moisture barrier material is not necessary. Referring to FIG. 2A, shown is an air-laying forming station which produces a web 80 on a forming fabric or screen 81. The forming fabric 81 can be in the form of an endless belt mounted on support rollers 83 and 84. A suitable driving device, such as an electric motor 86 rotates at least one of the support rollers 84 in a direction indicated by the arrows at a selected speed. As a result, the forming fabric 81 moves in a machine direction indicated by the arrow 86.

The air-laying forming station includes a forming chamber 86 having end walls and side walls. Within the forming chamber is a pair of material distributors 87 and 88 which distribute fibers and/or other particles inside the forming chamber across the width of the chamber. The material distributors can be, for instance, rotating cylindrical distributing screens. As shown, a single forming chamber is illustrated in association with the forming fabric 81. It should be understood, however, that more than one forming chamber can be included in the system. By including multiple forming chambers, layered webs can be formed in which each layer is made from the same or different materials.

Below the air-laying forming fabric 81 is a vacuum source 90, such as a conventional blower, for creating a selected pressure differential through the forming chamber 86 to draw the fibrous material against the forming fabric. If desired, a blower can also be incorporated into the forming chamber for assisting in blowing the fibers down on to the forming fabric. During operation, typically a fiber stock is fed to one or more defibrators (not shown) and fed to the material distributors 87 and 88. The material distributors distribute the fibers evenly throughout the forming chamber as shown. Positive airflow created by the vacuum source 50 and possibly an additional blower force the fibers onto the forming fabric thereby forming an air-laid web 80.

Referring to FIG. 2B, exiting one or more forming chambers 91A, 91B and 91C, air-laid web 80 is conveyed on a forming fabric to a compaction device 95. The compaction device can be, for instance, a pair of opposing rolls that define a nip through which the web and forming fabric are passed. The compaction device moderately compacts the web to generate sufficient strength for transfer of the web to a transfer fabric such as, for instance, via an open gap arrangement. Thus, after exiting the compaction device 95, the web 80 may be transferred to a transfer fabric. Once placed upon the transfer fabric, the web can be fed through an optional second compaction device and further compacted against the transfer fabric to generate desirable sheet properties. The compaction device(s) can be used to improve the appearance of the web, to adjust the caliper of the web, and/or to increase the tensile strength of the web.

The air-laid web 80 is then fed to a spray chamber 96. Within the spray chamber, a bonding material is applied to one side of the web. The bonding material can be deposited on the top side of the web using, for instance, spray nozzles. Under-fabric vacuum may also be used to regulate and control penetration of the bonding material into the web. The spray can be applied substantially uniformly or with gradients in the applied dosage or in patterns (e.g., by masking of spray).

Once the bonding material is applied to one side of the web, the web is then fed to a drying apparatus 98. In the drying apparatus, the web is subjected to heat causing the bonding material to dry and/or cure. When using an ethylene vinyl acetate copolymer bonding material, for instance, the drying apparatus can be heated to a temperature of from about 193° C. to about 205° C.

After the drying apparatus 98, the web is then fed to a second spray chamber 100. In the spray chamber 60, a second bonding material is applied to the untreated opposite side of the web. In general, the first bonding material and the second bonding material can be different bonding materials or the same bonding material. The second bonding material may be applied to the web as described above with respect to the first bonding material.

From the second spray chamber 100, the web is then sent through a second drying apparatus 102 for drying and/or curing the second bonding material. Thereafter, the web 80 may optionally be fed to a further compaction device 104 prior to being wound on a reel 106. The compaction device can be similar to the first compaction device and may comprise, for instance, calender rolls. After being wound on the reel, the web may be fed to a converting line for producing the finished product. For example, in the converting line, the web can be embossed and then wound into a rolled product, such as a paper towel, an industrial wiper, and the like.

Figure 5:
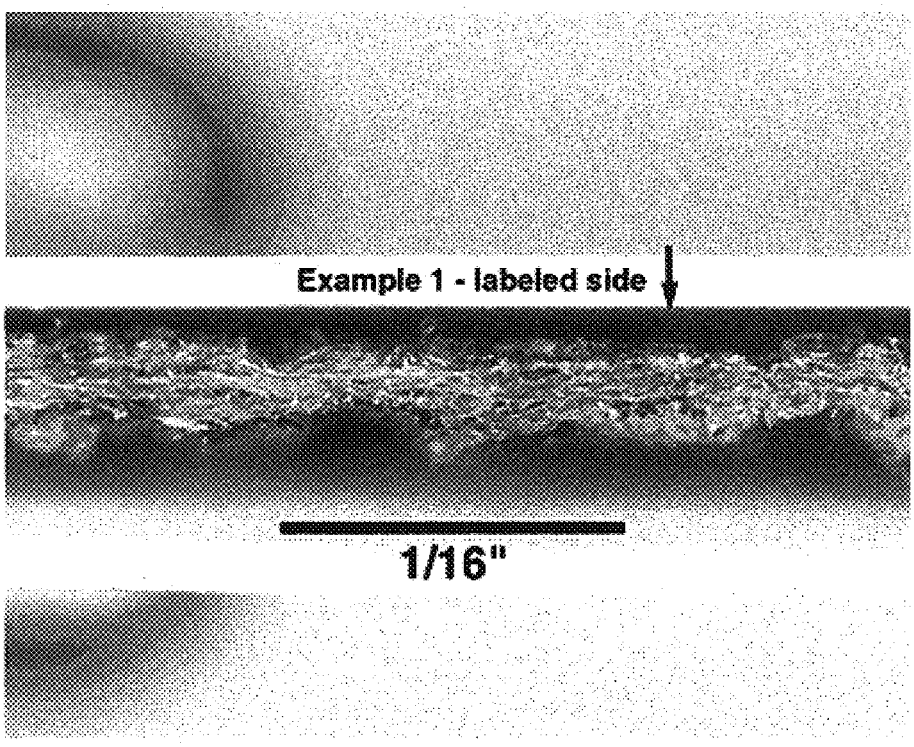
FIG. 5 is a cross-sectional color photograph of the product of Example 1.

FIGS. 3-5 are mentioned in connection with Example 1.

Figure 8:
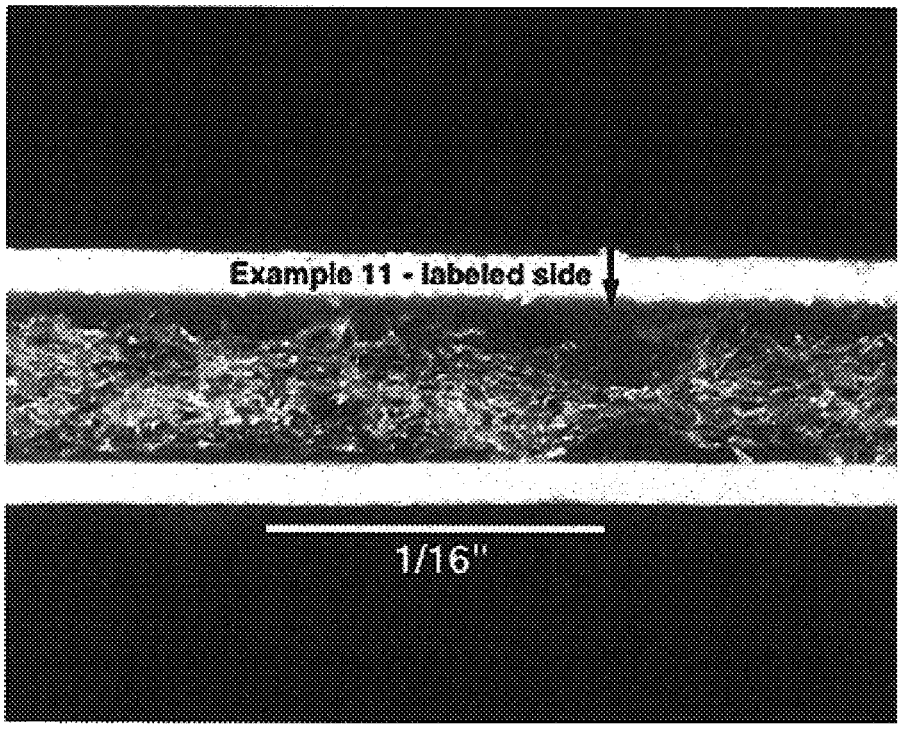
FIG. 8 is a cross-sectional color photograph of the product of Example 11.

FIGS. 6-8 are mentioned in connection with Example 4.

Figure 9:
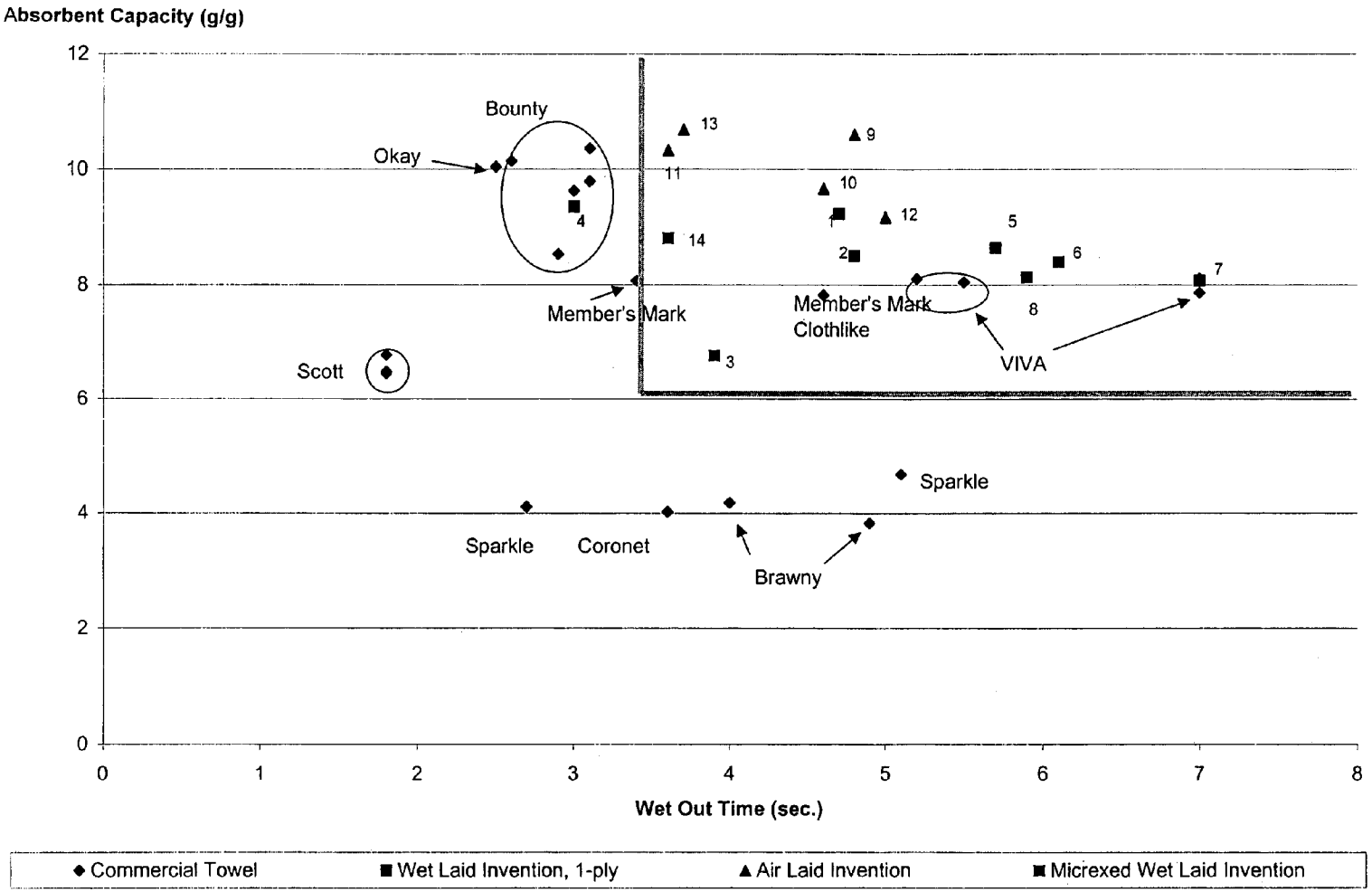
FIG. 9 is a plot of the Vertical Absorbent Capacity versus the Wet-Out Time for paper towel products of this invention made in accordance with the Examples described below and several commercially available paper towel products, illustrating the unique combination of absorbency properties of the products of this invention.

FIG. 9 is a plot summarizing the data from Examples 1-22.

Figure 10:
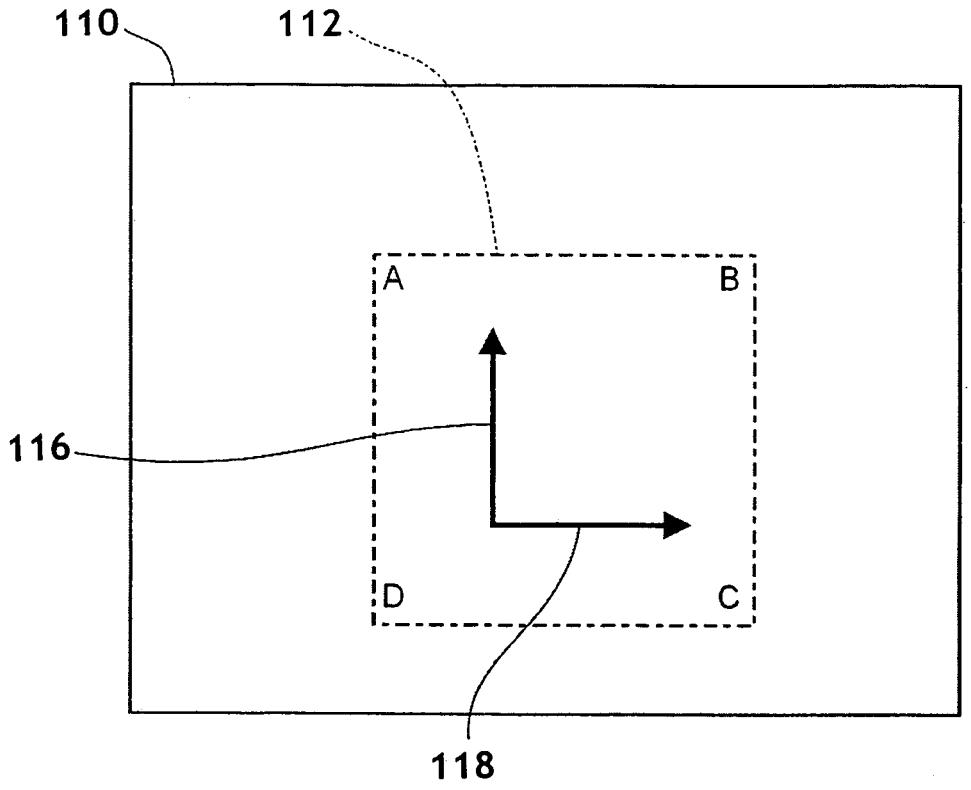
FIGS. 10-14 pertain to measuring the directional aspects of Vertical Absorbent Capacity and are discussed below.
Figure 11:
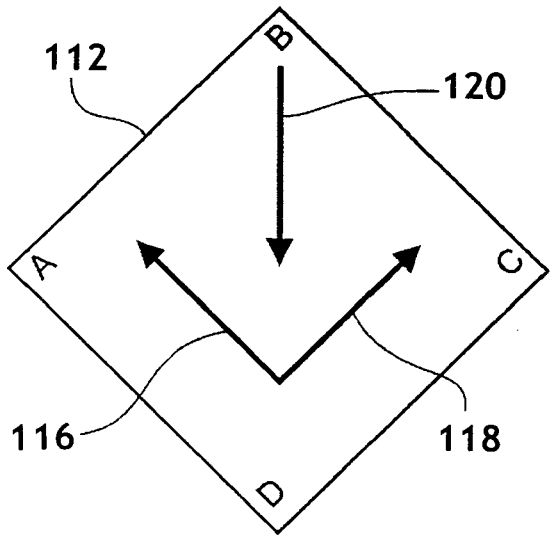

Referring now to FIGS. 10-14, further details pertaining to the directional aspects of Vertical Absorbent Capacity are illustrated. FIGS. 10 and 11 describe a standard configuration for preparing and testing samples. FIG. 10 shows a paper towel section 110 from which a rectangular sample 112 is to be cut. The paper towel section 110 has a machine direction 116 and a cross-machine direction 118 determined by the manufacturing process. Unless otherwise specified, the rectangular samples cut for testing according to the Vertical Absorbent Capacity procedure should be cut as shown, with the edges aligned with the machine direction 116 and cross-machine direction 118. The four corners of the sample 112 are labeled with labels A, B, C, and D to assist in describing the handling of the sample. When the sample is suspended by corner B during testing, the downward direction 120, the direction in which gravity acts and fluid drains, is intermediate to (e.g., at a 45° angle to) the machine direction 116 and cross-machine direction 118.

In many cases, substantially the same results will be given regardless of which corner is used to suspend the sample. Further, the alignment of sample sides relative to the machine direction 116 and cross-machine direction 118 may have little or no effect on the measured mass of the sample after drainage. When drainage results are not significantly affected by the choice of corner for suspending the sample or by the initial alignment of the sides of the sample 112 when cut from the paper towel section 110, the Vertical Absorbent Capacity is said to be isotropic.

In some cases, the drainage of liquid from a sample will depend upon the orientation of the downward direction 120 relative to the machine direction 116 and cross-machine direction 118 of the sample 112. For example, if hydrophobic matter has been printed in elongated, spaced-apart stripes running in the machine direction, then drainage may be impeded in the cross-direction relative to the machine direction. To examine the effect of sample orientation, further testing can be done with other sample orientations in addition to the standard orientations of FIGS. 10 and 11. In addition to testing the sample 112 suspended from corner B, testing can also be done with the sample suspended from corner A to observe differences that may be due to an applied pattern of liquid resistant material that is not aligned with the machine and cross-machine directions. The result of this test is termed the Rotated Vertical Absorbent Capacity.

Figure 12:
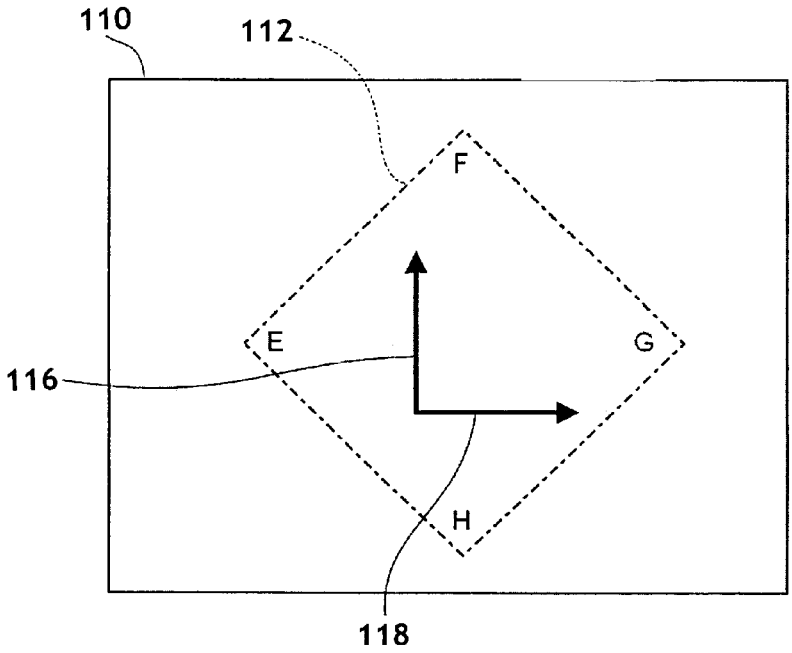
Figure 13:
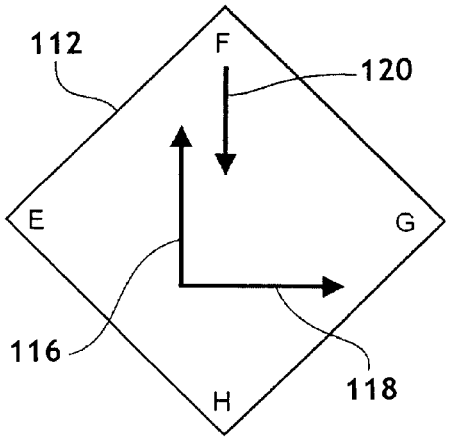
Figure 14:
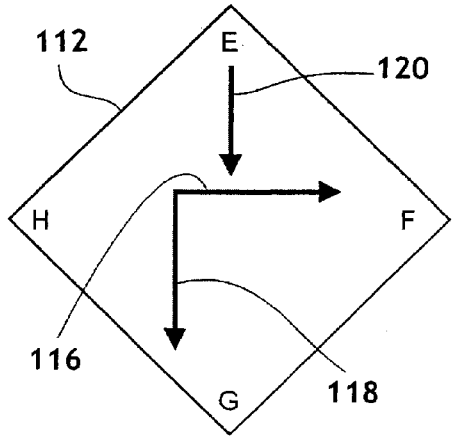

Additional procedures to examine drainage anisotropy (the lack of isotropic drainage behavior) are illustrated in FIGS. 12-14. FIG. 12 depicts a paper towel section 110 with a machine direction 116 and cross-machine direction 118 from which a rectangular sample 112 is to be cut with the sides of the sample 112 being rotated 45° relative to the standard orientation in FIG. 10, such that the sides are at 45° angles to the machine direction 106 and cross-machine direction 118. The sample 112 has four corners labeled E, F, G, and H. As shown in FIG. 13, when the wetted sample 112 is suspended from corner F, the downward direction 120 is aligned with the machine direction 116 (actually the negative machine direction), and this is the primary direction for fluid flow during drainage. Following the procedures for Vertical Absorbent Capacity but with the sample orientation shown in FIGS. 12 and 13 gives a value defined herein as the MD-modified Vertical Absorbent Capacity. When the sample is suspended by corner E, as shown in FIG. 14, the downward direction 120 is aligned with the cross-machine direction 118. Following the procedures for Vertical Absorbent Capacity but with the sample orientation shown in FIGS. 12 and 14 (downward direction 120 aligned with the cross-machine direction 118) gives a value defined herein as the CD-modified Vertical Absorbent Capacity. When material according to the present invention has a statistically significant difference of about 5% or greater between any two of the Vertical Absorbent Capacity, the Rotated Vertical Absorbent Capacity, the MD-modified Vertical Absorbent Capacity, and the CD-modified Vertical Absorbent Capacity, the sample is said to have an anisotropic Vertical Absorbent Capacity. The ratio of the largest value among the parameters (the Vertical Absorbent Capacity, the Rotated Vertical Absorbent Capacity, the MD-modified Vertical Absorbent Capacity, and the CD-modified Vertical Absorbent Capacity) to the smallest value among the parameters is the Anisotropy Factor for Vertical Absorbent Capacity. The Anisotropy Factor is about 1 for isotropic materials, but for anisotropic materials it can be about 1.05 or greater, specifically about 1.1 or greater, more specifically about 1.2 or greater, and most specifically about 1.5 or greater, such as from about 1.05 to about 2.5, or from about 1.1 to about 2, or from 1.1 to about 1.5.

In some cases, the CD-modified Vertical Absorbent Capacity and the MD-modified Vertical Absorbent Capacity can be substantially the same, but significantly different than the Vertical Absorbent Capacity. Such examples may occur, by way of example only, when hydrophobic matter is printed in a pattern with lines or stripes oriented at 45-degrees to the MD and CD directions. In other cases, the Vertical Absorbent Capacity can be intermediate between significantly different values of the CD-modified Vertical Absorbent Capacity and the MD-modified Vertical Absorbent Capacity. For example, the ratio of CD-modified Vertical Absorbent Capacity to MD-modified Vertical Absorbent Capacity can be less than or greater than 1, such as any of the following ranges: from about 0.2 to about 0.95 from about 0.2 to about 0.9, from about 0.5 to about 0.9, from about 1.05 to about 2, from about 1.1 to about 2, and from about 1.2 to about 2.5. Similar ranges apply to the ratio of Vertical Absorbent Capacity to Rotated Vertical Absorbent Capacity, the ratio of Vertical Absorbent Capacity to MD-modified Vertical Absorbent Capacity, and the ratio of Vertical Absorbent Capacity to CD-modified Vertical Absorbent Capacity.

Figure 15:
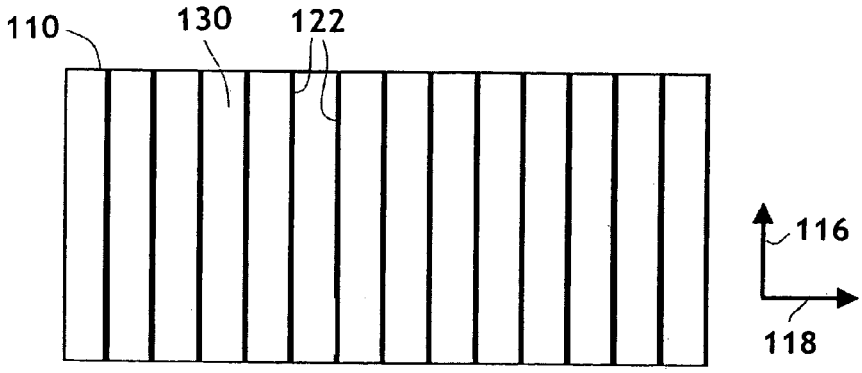
FIGS. 15, 16A-16F and 17 are illustrations of deposition patterns for moisture barrier materials in accordance with this invention.
Figure 16A:
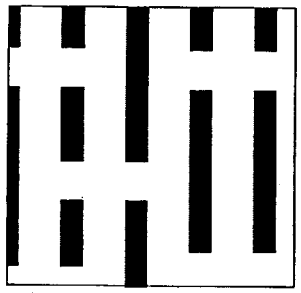
Figure 16B:
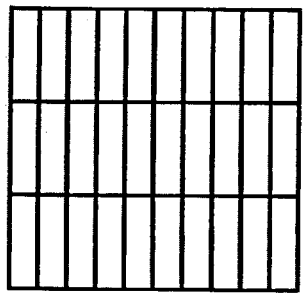
Figure 16C:
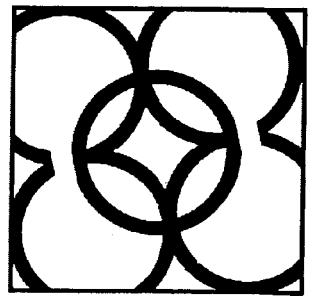
Figure 16D:
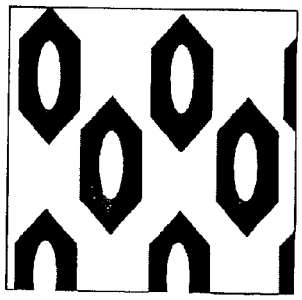
Figure 16E:
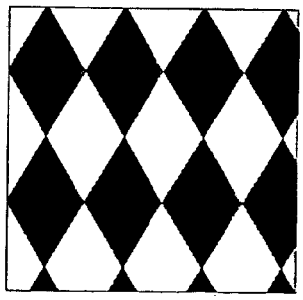
Figure 16F:
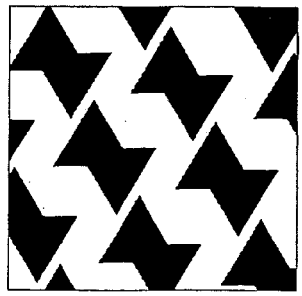

FIG. 15 depicts a paper section 110 with a simple pattern of straight lines of hydrophobic matter 132, with unprinted regions 130 therebetween. The lines are aligned in the machine direction 116. An Anisotropy Factor greater than 1 is expected for this case, if the printed regions 130 are sufficient to serve as barriers to liquid drainage when tested with the cross-machine direction 118 aligned with the direction of gravity. Adjusting the basis weight, depth of penetration, hydrophobicity, number density (lines per inch), and thickness of the lines are among the steps that can be taken by one skilled in the art to modify the Anisotropy Factor.

FIGS. 16A-16E show other representative patterns that can be used. Because these patterns may present greater barriers to flow in certain directions, Anisotropy Factors above unity may be expected, depending on the nature of the materials and application methods used.

Figure 17:
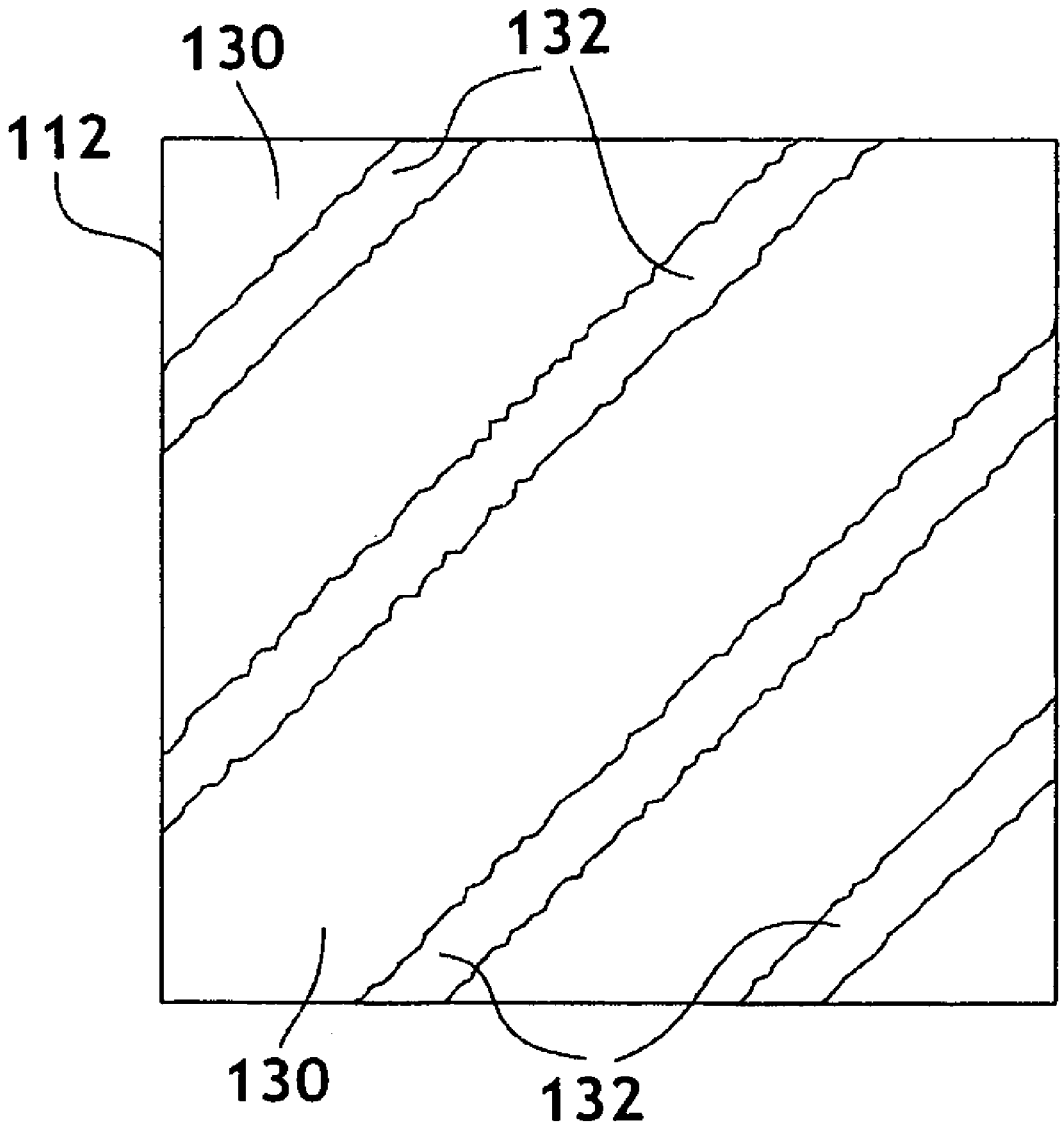

FIG. 17 is discussed below in connection with Example 24.

EXAMPLES

Example 1

A pilot tissue machine was used to produce a layered, uncreped throughdried towel basesheet in accordance with this invention generally as described in FIG. 1. After manufacture on the tissue machine, the uncreped throughdried basesheet was printed on each side with a latex binder (moisture barrier coating). The binder-treated sheet was adhered to the surface of a Yankee dryer to re-dry the sheet and thereafter the sheet was creped. The resulting sheet was converted into rolls of single-ply paper towels in a conventional manner.

More specifically, the basesheet was made from a stratified fiber furnish containing a center layer of fibers positioned between two outer layers of fibers. Both outer layers of the basesheet contained 100% northern softwood kraft pulp and about 6 kilograms (kg)/metric ton (Mton) of dry fiber of a debonding agent (ProSoft® TQ1003 from Hercules, Inc.). Each of the outer layers comprised 25% of the total fiber weight of the sheet. The center layer, which comprised 50% of the total fiber weight of the sheet, was comprised of 50% by weight of northern softwood kraft pulp and 50% by weight of a softwood bleached chemi-thermomechanical pulp (Millar Western). The fibers in this layer were also treated with 6 kb/Mton of ProSoft® TQ1003 debonder.

The machine-chest furnish containing the chemical additives was diluted to approximately 0.2 percent consistency and delivered to a layered headbox. The forming fabric speed was approximately 1450 feet per minute (fpm) (442 meters per minute). The basesheet was then rush transferred to a transfer fabric (Voith Fabrics, 807) traveling 15% slower than the forming fabric using a vacuum roll to assist the transfer. At a second vacuum-assisted transfer, the basesheet was transferred and wet-molded onto the throughdrying fabric (Voith Fabrics, t4803-7). The sheet was dried with a through air dryer resulting in a basesheet having an air-dry basis weight of 52.8 grams per square meter (gsm).

As shown in FIG. 1B, the resulting sheet was fed to a gravure printing line where the latex binder was printed onto the surface of the sheet. The first side of the sheet was printed with a binder formulation using direct rotogravure printing. The sheet was printed with a 0.020 diameter "dot" pattern as shown in FIG. 1C wherein 28 dots per inch were printed on the sheet in both the machine and cross-machine directions. The resulting surface area coverage was approximately 25%. Then the printed sheet passed over a heated roll to evaporate water.

Next, the second or opposite side of the sheet was printed with the same latex binder formulation using a second direct rotogravure printer. The sheet was printed with discrete shapes, where each shape was comprised of three elongated hexagons as illustrated in FIG. 1D. Each hexagon within each discrete shape was approximately 0.02 inches long with a width of about 0.006 inches. The hexagons within a discrete shape were essentially in contact with each other and aligned in the machine direction. The spacing between discrete shapes was approximately the width of one hexagon. The sheet was printed with 40 discrete shapes per inch in the machine direction and 40 elements per inch in the cross-machine direction. The resulting surface area coverage was approximately 50%. Of the total latex binder material applied, roughly 60% was applied to the first side and 40% to the second side of the web, even though the surface area coverage of the second side was greater than that of the first side. This arrangement provided for greater penetration of the binder material into the sheet by the first pattern than the second pattern, which remained substantially on the surface of the second side of the sheet.

The sheet was then pressed against and doctored off a rotating drum, which had a surface temperature of 52° C. Finally the sheet was dried and the binder material cured using air heated to 260° C. and wound into a roll. Thereafter, the resulting print/print/creped sheet was converted into rolls of single-ply paper toweling in a conventional manner. The finished product had an air dry basis weight of 64.8 gsm.

The latex binder material in this example was a vinyl acetate ethylene copolymer, Airflex® EN1165, which was obtained from Air Products and Chemicals, Inc. of Allentown, Pa. The add-on amount of the binder applied to the sheet was approximately 7 weight percent.

The binder formulation contained the following ingredients:

| | | |
|---|---|---|
| 1. | Airflex ® EN1165 (52% solids) | 10,500 g |
| 2. | Defoamer (Nalco 94PA093) | 54 g |
| 3. | Water | 3,000 g |
| 4. | Catalyst (10% $NH_4Cl$) | 545 g |
| 5. | Thickener (2% Natrosol 250MR, Hercules) | 1,100 g |

All testing of absorbency properties was done on finished product. The resulting single-ply towel had a Vertical Absorbent Capacity of 9.2 grams per gram (g/g) and a Wet-Out Time of 4.7 seconds. Photographs of the product are shown in FIGS. 3-5.

Example 2

A single-ply towel was produced as described in Example 1, except the binder material composition contained the following ingredients.

| | | |
|---|---|---|
| 1. | Airflex-426 (Air Products, 63% solids) | 8,000 g |
| 2. | Defoamer (Nalco 94PA093) | 50 g |
| 3. | Water | 3,920 g |
| 4. | Reactant (40% glyoxal) | 1250 g |
| 5. | Thickener (2% Natrosol 250MR, Hercules) | 1,050 g |

The finished product had an air dry basis weight of 67.3 gsm. The towel had a Vertical Absorbent Capacity of 8.5 g/g and a Wet-Out Time of 4.8 seconds.

Example 3

A single-ply towel was produced as described in Example 1, except the fiber furnish for each layer was changed. The outer layers, comprising 25% of total fiber weight of the sheet in each layer, consisted of 100% bleached northern softwood kraft fiber which had been mechanically refined at 0.5 horsepower days/ton. The center layer, comprising 50% of the total fiber weight, contained 50% bleached northern softwood kraft fiber which had been treated with 5 kg/Mton of ProSoft TQ1003 debonder and had been processed through a disperser for mechanical treatment of the fibers, and 50% BCTMP fibers. The basesheet was produced on the same tissue machine as Example 1, except that the transfer fabric was traveling 30% slower than the forming fabric, and an alternate throughdrying fabric (Voith Fabrics, t1203-1) was used. The air dry basis weight of the basesheet was 53.7 gsm. The basesheet was printed on both sides with the latex binder formulation described in Example 1, but was removed from the rotating drum without the use of a doctor blade. Prior to winding the basesheet into rolls, it was foreshortened using a micro-creping process as described in the aforementioned Parsons et al patent. Micro-creping equipment is available from Micrex Corporation, 17 Industrial Road, Walpole, Mass. 02081. The main roll of the Micrex unit was a flame-sprayed drum with a rough surface to hold the web during the micro-creping process. The total thickness of the flexible retarder blades was 0.007 inches (one 0.003 inch and one 0.004 inch thick blade). The thickness of the flexible primary surface blade was 0.030 inch. The cavity used was the primary surface blade thickness of 0.03 inches. The stickout was ⅛ inch (3.18 mm) past the primary surface blade. The rigid retarder was made of steel with a razor sharp edge with the beveled edge against the flame sprayed drum. A 1.25 crepe ratio or 20% compaction was used to wind the material into a hard roll. The pressure on the pressure plate was 30 psi.

The resulting micro-creped basesheet was converted into finished rolls of single-ply paper toweling. The finished product had an air dry basis weight of 58.4 gsm. The product had a Vertical Absorbent Capacity of 6.8 g/g and a Wet-Out Time of 3.9 seconds.

Example 4

A single-ply towel was produced as described in Example 1, except the fibers were treated with 5 kg/Mton of ProSoft TQ1003 debonder. Additionally, the transfer fabric was traveling 45% slower than the forming fabric and an alternate throughdrying fabric (Voith Fabrics, t1203-1) was used. The air dry basis weight of the basesheet was 52.0 gsm. The basesheet was printed with latex binder and converted as described in Example 1. The finished product had an air dry basis weight of 48.3 gsm. The product had a Vertical Absorbent Capacity of 9.4 g/g and a Wet-Out Time of 3.0 seconds.

Example 5

A single-ply towel was produced as described in Example 1, except the fibers were 100% bleached northern softwood kraft and were treated with 3.4 kg/Mton of ProSoft TQ1003 debonder. Additionally, an alternate throughdrying fabric (Voith Fabrics, t1203-1) was used. The air dry basis weight of the basesheet was 56.9 gsm. The basesheet was printed with latex binder and converted as described in Example 1. The finished product had an air dry basis weight of 71.2 gsm. The product had a Vertical Absorbent Capacity of 8.7 g/g and a Wet-Out Time of 5.7 seconds.

Example 6

A single-ply towel was produced as described in Example 5, except the transfer fabric was traveling 25% slower than the forming fabric. The air dry basis weight of the basesheet was 69.2 gsm. The basesheet was printed with latex binder and converted as described in Example 1. The finished product had an air dry basis weight of 74.8 gsm. The product had a Vertical Absorbent Capacity of 8.4 g/g and a Wet-Out Time of 6.1 seconds.

Example 7

A single-ply towel was produced as described in Example 6, except the debonder level applied to the furnish was 3.3 kg/Mton. The air dry basis weight of the basesheet was 65.9 gsm. Additionally, the basesheet was printed with the binder formulation described in Example 2. The finished product had an air dry basis weight of 69.3 gsm. The product had a Vertical Absorbent Capacity of 8.1 g/g and a Wet-Out Time of 7.0 seconds.

Example 8

A single-ply towel was produced as described in Example 6, except the debonder level applied to the furnish was 3.0 kg/Mton. Additionally, an alternate throughdryer fabric (Voith Fabrics, t4807-3) was used. The air dry basis weight of the basesheet was 59.8 gsm. The basesheet was printed and converted as described in Example 1. The finished product had an air dry basis weight of 68.0 gsm. The product had a Vertical Absorbent Capacity of 8.1 g/g and a Wet-Out Time of 5.9 seconds.

Example 9

A single-ply towel was produced using an air-laid process substantially as described in FIG. 2. Specifically, 100% Biobrite pulp (a softwood pulp obtained from Finland) was defiberized in a hammer mill and the fibers transported to a web forming unit. A web was then air formed in an air-forming unit and the resulting web conveyed via the forming fabric between two compaction rolls with a steel roll against the web and a rubber roll against the forming fabric. The web was compacted sufficiently to generate enough strength to transfer via an open gap to a transfer fabric.

The web was conveyed via the transfer fabric between two rolls (again, steel against the web and rubber against the fabric) and further compacted against the transfer fabric. In this case, an Electrotech ET 56 fabric (manufactured by Albany International Corporation) was used as the transfer fabric.

The web was then transferred to a spray cabin wire. A latex binder, Elite PE from National Starch, was deposited on the top side of the web via spray nozzles. Under-wire vacuum was regulated to control the binder penetration into the web. The latex binder add-on was approximately 8.5% by weight.

The web was then transferred to the dryer section and conveyed between two fabrics for curing of the binder. The binder was cured at a temperature of 380-400° F. with a dwell time of approximately 10 seconds.

The web was then transferred to a second spray cabin wire and a binder deposited on the opposite side of the web via spray nozzles. Again, under-wire vacuum was regulated to control binder penetration into the web. Next, the web was transferred to a second dryer section and conveyed between two fabrics for binder curing. Again the web was cured at a temperature of 193-204° C. The web was then conveyed to the reel section and wound into a parent roll.

Finally, the web was unwound from the parent roll and embossed using a steel/rubber embossing process. The embossing rolls were a Northern Engraving Pattern N1784 steel roll with 40 elements per square inch, an element depth of 0.055 inch (1.40 mm) and a sidewall angle of 30 degrees, and a 65 Shore A hardness nitrile rubber backing roll, respectively. The nip gap was set at 20 mm in the embossing section.

The resulting air-laid towel had a Vertical Absorbent Capacity of 10.6 g/g and a Wet-Out Time of 4.8 seconds. The air dry basis weight of the finished product was 71.8 gsm.

Example 10

An air-laid basesheet was made as above except the embossing nip gap was increased to 43 mm. The towel had a Vertical Absorbent Capacity of 9.7 g/g and a Wet-Out Time of 4.6 seconds. The air dry basis weight of the finished product was 68.9 gsm.

Example 11

A single-ply towel was produced as described in Example 10, except the sheet basis weight reduced and the latex binder addition was increased to 12.5%. The towel had a Vertical Absorbent Capacity of 10.3 g/g and a Wet-Out Time of 3.6 seconds. The air dry basis weight of the finished product was 56.9 gsm. Photographs of the product are shown in FIGS. 6-8.

Example 12

A single-ply towel was produced as described in Example 10, except an Electrotech ET 36B fabric was used in place of the ET 56 fabric. The product had a Vertical Absorbent Capacity of 9.2 g/g and a Wet-Out Time of 5.0 seconds. The air dry basis weight of the finished product was 72.7 gsm.

Example 13

A single-ply towel was produced as described in Example 10, except an ET 36B fabric was used in place of the ET 56 fabric and the basis weight of the sheet was reduced. The product had a Vertical Absorbent Capacity of 10.7 g/g and a Wet-Out Time of 3.7 seconds. The air dry basis weight of the finished product was 58.5 gsm.

Example 14

A two-ply towel was produced using basesheets as described in Example 3, except that the outer layer against the TAD fabric, comprising 25% of the fiber weight for each ply, was 100% bleached northern softwood Kraft pulp which had been passed through a Maule shaft disperser. The center layer, comprising 50% of the fiber weight of each ply, was 100% bleached northern softwood Kraft pulp. The air side layer, comprising 25% of the fiber weight of each ply, was 100% BCTMP. The basesheet was produced on the same tissue machine as Example 1, except that the transfer fabric was traveling 35% slower than the forming fabric and basis weight was one half of the value of Example 1. Also, no chemical debonder was used and this prototype was printed with latex binder using a Flexographic process instead of direct Rotogravure after it was micro-creped.

After manufacture on the tissue machine, the two plies of the basesheet were micro-creped simultaneously. A 0.006 inch thick flexible retarder blade was used with a ⅛ inch stick-out. One 0.010 inch thick primary surface blade was used. Three 0.010 inch thick primary back up blades were used which created a 0.030 inch cavity or folding zone. A 1.25 crepe ratio or 20% compaction was used to wind the material into a hardroll. The pressure on the pressure plate was 30 psi. The latex binder was added to the fabric side of each ply simultaneously using a duplex flexographic printing process.

The two-ply roll described above was placed on a winder which had a Nordson Corporation hot melt spray unit and a rubber/steel calender were added before a conventional household towel winder. The two plies were hot melted laminated together using 0.9 gsm of 34-625A sulfonated polyester hot melt adhesive from National Starch,& Chemical of Bridgewater, N.J. Immediately after the hot melt adhesive was sprayed, both plies were passed through a calender nip formed between a 90 Shore A durometer rubber roll and a steel roll, at a load of 20 pli, to ensure good lamination of the two plies.

The resulting two-ply towel product had a Vertical Absorbent Capacity of 8.8 g/g and a Wet-Out Time of 3.6 seconds. The air dry basis weight of the finished product was 68.7 gsm.

Example 15

Commercial Towel

A sample of Kleenex® Brand VIVA® towel, procured in May 2002, was tested as described above. The 1-ply towel had a basis weight of 64.2 gsm, a Vertical Absorbent Capacity of 8.09 g/g and a Wet-Out Time of 4.6 seconds.

Example 16

Commercial Towel

A sample of SCOTT® Towel, procured in January 2002, was tested as described above. The 1-ply towel had a basis weight of 41.6 gsm, a Vertical Absorbent Capacity of 6.66 g/g and a Wet-Out Time of 2.5 seconds.

Example 17

Commercial Towel

A sample of Brawny® towel, procured in March 2000, was tested as described above. The 2-ply towel had a basis weight of 46.3 gsm, a Vertical Absorbent Capacity of 4.35 g/g and a Wet-Out Time of 4.3 seconds.

Example 18

Commercial Towel

A sample of Coronet® towel, procured in March 2000, was tested as described above. The 1-ply towel had a basis weight of 51.1 gsm, a Vertical Absorbent Capacity of 4.11 g/g and a Wet-Out Time of 4.0 seconds.

Example 19

Commercial Towel

A sample of Sparkle® towel, procured in September 2001, was tested as described above. The 2-ply towel had a basis weight of 46.3 gsm, a Vertical Absorbent Capacity of 4.11 g/g and a Wet-Out Time of 2.7 seconds.

Example 20

Commercial Towel

A sample of Bounty Double Quilted™ R roll towel, procured in March 2002, was tested as described above. The 2-ply towel had a basis weight of 38.2 gsm, a Vertical Absorbent Capacity of 10.84 g/g and a Wet-Out Time of 3.1 seconds.

Example 21

Commercial Towel

A sample of Bounty Double Quilted™ XL roll towel, procured in June 2001, was tested as described above. The 2-ply towel had a basis weight of 45.6 gsm, a Vertical Absorbent Capacity of 9.01 g/g and a Wet-Out Time of 2.9 seconds.

Example 22

Commercial Towel

A sample of Bounty Double Quilted™ XXL roll towel, procured in June 2001, was tested as described above. The towel had a basis weight of 45.8 gsm, a Vertical Absorbent Capacity of 8.75 g/g and a Wet-Out Time of 2.6 seconds.

The results of the foregoing examples are summarized in Tables 1 and 2 below. For ease of comparison, FIG. 9 is a plot of the absorbent properties of the products of this invention (Examples 1-14) and the absorbent properties of commercially available products (Examples 15-22).

TABLE 1

| Invention Samples | | | | | |
|---|---|---|---|---|---|
| Example ID Number | As is Basis Weight (gsm) | Plies | Vertical Absorbent Capacity (g/g) | Wet-Out Time (s) | Stack Bulk |
| 1 | 64.8 | 1 | 9.2 | 4.7 | 11.6 |
| 2 | 67.3 | 1 | 8.5 | 4.8 | 12.5 |
| 3 | 58.4 | 1 | 6.8 | 3.9 | 8.3 |

TABLE 1-continued

| Invention Samples | | | | | |
|---|---|---|---|---|---|
| Example ID Number | As is Basis Weight (gsm) | Plies | Vertical Absorbent Capacity (g/g) | Wet-Out Time (s) | Stack Bulk |
| 4 | 48.3 | 1 | 9.4 | 3.0 | 12.0 |
| 5 | 71.2 | 1 | 8.7 | 5.7 | 10.7 |
| 6 | 74.8 | 1 | 8.4 | 6.1 | 9.4 |
| 7 | 69.3 | 1 | 8.1 | 7.0 | 9.6 |
| 8 | 68.0 | 1 | 8.1 | 5.9 | 9.6 |
| 9 | 71.8 | 1 | 10.6 | 4.8 | 10.6 |
| 10 | 68.9 | 1 | 9.7 | 4.6 | 9.7 |
| 11 | 56.9 | 1 | 10.3 | 3.6 | 11.1 |
| 12 | 72.7 | 1 | 9.2 | 5.0 | 8.7 |
| 13 | 58.5 | 1 | 10.7 | 3.7 | 10.9 |
| 14 | 68.7 | 2 | 8.8 | 3.6 | 8.7 |

Aditional product data for the samples above is included in Table 2 below.

TABLE 2

| Invention Samples (Additional Data) | | | | | | | |
|---|---|---|---|---|---|---|---|
| | | Example ID Number | | | | | |
| | | 1 | | 2 | | 3 | |
| Test | Units | Avg. | Std. Dev. | Avg. | Std. Dev. | Avg. | Std. Dev. |
| Roll Properties | | | | | | | |
| Diameter | inches | 5.052 | 0.060 | | | 4.869 | 0.023 |
| Diameter | mm | 128.0 | 2.0 | | | 124.0 | 1.0 |
| Firmness - Kershaw | mm | 6.50 | 0.20 | | | 7.60 | 0.20 |
| Sheet Count | sheets | 55 | 0 | | | 74 | 0 |
| Roll Weight - bone dry | grams | 92.61 | 4.19 | | | 299.98 | 1.51 |
| Sheet Properties | | | | | | | |
| Ply | | 1 | | | | 1 | |
| Length | mm | 287 | 5 | 275 | | 278 | 2 |
| Width | mm | 276 | 6 | 285 | | 283 | 1 |
| Absorbency | | | | | | | |
| Capacity - vertical | grams | 5.99 | 0.25 | 5.89 | 0.14 | 3.94 | 0.06 |
| Capacity - vertical | grams/gram | 9.24 | 0.25 | 8.51 | 0.12 | 6.77 | 0.05 |
| Wet-Out Time | seconds | 4.70 | 0.60 | 4.80 | 0.10 | 3.90 | 0.20 |
| Total Sheet Absorbency | grams | 46.0 | | 44.7 | | 30.0 | |
| Bulk | | | | | | | |
| Basis Weight - as is | #/2880 $ft^2$ | 38.21 | 0.49 | 39.67 | 0.10 | 34.43 | 0.85 |
| Basis Weight - bone dry | #/2880 $ft^2$ | 35.82 | 0.45 | 36.91 | 0.08 | 32.27 | 0.80 |
| Basis Weight - as is | $g/m^2$ | 64.77 | 0.83 | 67.26 | 0.17 | 58.37 | 1.44 |
| Basis Weight - bone dry | $g/m^2$ | 60.73 | 0.77 | 62.58 | 0.13 | 54.72 | 1.36 |
| Caliper 1-sheet | inches | 0.0330 | 0.0014 | 0.0369 | 0.0080 | 0.0201 | 0.0004 |
| Caliper 10-sheet | inches | 0.295 | 0.007 | 0.330 | 0.005 | 0.179 | 0.004 |
| Stack Bulk | $cm^3/g$ | 11.560 | 0.400 | 12.460 | 0.020 | | |
| Strength | | | | | | | |
| GMT | | 1387 | | 1355 | | 1477 | |

TABLE 2-continued

| Invention Samples (Additional Data) | | | | | | | |
|---|---|---|---|---|---|---|---|
| MD Tensile | grams/3" | 1602 | 89 | 1628 | 64 | 1603 | 119 |
| MD Stretch | % | 26.2 | 2.9 | 29.2 | 1.6 | 24.1 | 2.1 |
| MD TEA at Fail | GmCm/Cm$^2$ | 24.86 | 3.66 | 24.25 | 1.65 | 24.20 | 2.81 |
| MD Slope (A) | Kg | 2.99 | 0.24 | 2.42 | 0.14 | 3.40 | 0.26 |
| CD Tensile | grams/3" | 1201 | 69 | 1128 | 45 | 1361 | 96 |
| CD Stretch | % | 14.5 | 1.1 | 11.5 | 0.7 | 12.2 | 0.8 |
| CD TEA at Fail | GmCm/Cm$^2$ | 19.04 | 2.11 | 15.85 | 1.10 | 16.01 | 2.11 |
| CD Slope (A) | Kg | 8.96 | 0.92 | 11.47 | 0.43 | 9.94 | 0.64 |
| Dry Burst | grams | 539.0 | 76.4 | 434.6 | 83.3 | 497.7 | 40.5 |
| Wet Strength | | | | | | | |
| CD Wet (pad) | grams | 879.4 | 44.7 | 700.7 | 24.5 | 734.7 | 65.2 |
| CD Wet Stretch | % | 10.8 | 0.6 | 8.2 | 0.3 | 8.9 | 0.4 |
| Wet CD TEA at Fail | GmCm/Cm$^2$ | 8.97 | 0.40 | 6.08 | 0.30 | 6.14 | 0.72 |
| Wet CD Slope (A) | Kg | | | | | | |
| CD Wet/Dry Ratio (pad) | % | 73.2 | | 62.1 | | 54.0 | |
| Dispensing | | | | | | | |
| Detach | grams | 1230 | | | | 1369 | 86 |
| Detach/CD Ratio | | 1.0 | | | | 1.0 | |
| Appearance | | | | | | | |
| Opacity - ISO | % | 75.17 | 0.71 | 73.94 | 0.34 | 75.65 | 0.88 |
| Brightness | % | 75.18 | 1.01 | 83.76 | 0.15 | 74.34 | 1.81 |
| TB-1C Color L | L | 92.56 | 0.27 | 94.19 | 0.01 | 92.10 | 0.38 |
| a (red/green) | A | −0.40 | 0.05 | −0.23 | 0.06 | −0.26 | 0.03 |
| b (blue/yellow) | B | 8.38 | 0.41 | 4.19 | 0.03 | 8.47 | 0.88 |

| | | Example ID Number | | | | | |
|---|---|---|---|---|---|---|---|
| | | 4 | | 5 | | 6 | |
| Test | Units | Avg. | Std. Dev. | Avg. | Std. Dev. | Avg. | Std. Dev. |
| Roll Properties | | | | | | | |
| Diameter | inches | | | 5.026 | 0.023 | 5.105 | 0.023 |
| Diameter | mm | | | 128.000 | 1.000 | 130.000 | 1.000 |
| Firmness - Kershaw | mm | | | 5.30 | 0.40 | 6.40 | 0.30 |
| Sheet Count | sheets | | | 56 | | 56 | |
| Roll Weight - bone dry | grams | | | 102.53 | 2.79 | 110.40 | 1.66 |
| Sheet Properties | | | | | | | |
| Ply | | 1 | | 1 | | 1 | |
| Length | mm | 275 | | 284 | 4 | 285 | 1 |
| Width | mm | 285 | | 285 | 3 | 285 | 1 |
| Absorbency | | | | | | | |
| Capacity - vertical | grams | 4.57 | 0.18 | 6.29 | 0.16 | 6.49 | 0.11 |
| Capacity - vertical | grams/gram | 9.36 | 0.36 | 8.65 | 0.10 | 8.40 | 0.10 |
| Wet-Out Time | seconds | 3.00 | 0.10 | 5.70 | 0.20 | 6.10 | 0.20 |
| Total Sheet Absorbency | grams | 34.7 | | 49.3 | | 51.1 | |
| Bulk | | | | | | | |
| Basis Weight - as is | #/2880 ft$^2$ | 28.51 | 0.17 | 41.97 | 0.70 | 44.13 | 0.32 |
| Basis Weight - bone dry | #/2880 ft$^2$ | 26.68 | 0.17 | 39.55 | 0.64 | 41.58 | 0.32 |
| Basis Weight - as is | g/m$^2$ | 48.33 | 0.28 | 71.16 | 1.18 | 74.81 | 0.55 |
| Basis Weight - bone dry | g/m$^2$ | 45.23 | 0.29 | 67.05 | 1.09 | 70.50 | 0.54 |
| Caliper 1-sheet | inches | 0.0238 | 0.011 | 0.0317 | 0.0008 | 0.0298 | 0.0007 |
| Caliper 10-sheet | inches | 0.214 | 0.002 | 0.300 | 0.005 | 0.278 | 0.006 |
| Stack Bulk | cm$^3$/g | 11.25 | 0.10 | 10.710 | 0.240 | 9.450 | 0.200 |
| Strength | | | | | | | |
| GMT | | 1069 | | 1615 | | 1577 | |
| MD Tensile | grams/3" | 1256 | 87 | 1763 | 108 | 1787 | 95 |
| MD Stretch | % | 23.0 | 1.9 | 33.6 | 2.3 | 25.0 | 1.0 |
| MD TEA at Fail | GmCm/Cm$^2$ | 23.55 | 1.26 | 39.81 | 4.24 | 35.52 | 1.45 |
| MD Slope (A) | Kg | 5.36 | 0.80 | 3.66 | 0.34 | 6.15 | 0.54 |
| CD Tensile | grams/3" | 911 | 50 | 1480 | 104 | 1393 | 98 |
| CD Stretch | % | 18.0 | 0.6 | 16.5 | 0.9 | 16.9 | 0.6 |
| CD TEA at Fail | GmCm/Cm$^2$ | 15.95 | 1.52 | 23.88 | 2.79 | 22.89 | 2.03 |
| CD Slope (A) | Kg | 4.66 | 0.44 | 7.64 | 0.92 | 7.31 | 0.68 |
| Dry Burst | grams | 489.5 | 56.7 | 589.4 | 61.1 | 656.8 | 37.1 |
| Wet Strength | | | | | | | |
| CD Wet (pad) | grams | 614.6 | 40.8 | 970.1 | 73.2 | 881.8 | 59.8 |

TABLE 2-continued

| Invention Samples (Additional Data) | | | | | | | |
|---|---|---|---|---|---|---|---|
| CD Wet Stretch | % | 13.4 | 0.5 | 12.9 | 0.6 | 13.3 | 0.4 |
| Wet CD TEA at Fail | GmCm/Cm$^2$ | 7.23 | 0.73 | 11.22 | 0.98 | 10.24 | 0.91 |
| Wet CD Slope (A) | Kg | | | 5.60 | 0.57 | 5.16 | 0.44 |
| CD Wet/Dry Ratio (pad) | % | 67.5 | | 65.6 | | 63.3 | |
| Dispensing | | | | | | | |
| Detach | grams | | | 1356 | | 1526 | |
| Detach/CD Ratio | | | | 0.9 | | 1.1 | |
| Appearance | | | | | | | |
| Opacity - ISO | % | | | 73.66 | 0.68 | 75.93 | 0.29 |
| Brightness | % | | | 83.98 | 0.23 | 82.85 | 0.30 |
| TB-1C Color L | L | | | 95.76 | 0.07 | 95.58 | 0.06 |
| a (red/green) | A | | | −1.13 | 0.03 | −1.11 | 0.05 |
| b (blue/yellow) | B | | | 5.84 | 0.12 | 6.41 | 0.16 |

| | | Example ID Number | | | | | |
|---|---|---|---|---|---|---|---|
| | | 7 | | 8 | | 9 | |
| Test | Units | Avg. | Std. Dev. | Avg. | Std. Dev. | Ave | Std. Dev. |
| Roll Properties | | | | | | | |
| Diameter | inches | 5.131 | 0.159 | 4.843 | 0.039 | 5.075 | 0.039 |
| Diameter | mm | 130.000 | 4.000 | 123.000 | 1.000 | 129.0 | 1.00 |
| Firmness - Kershaw | mm | 6.60 | 0.40 | 7.50 | 0.40 | 5.60 | 0.40 |
| Sheet Count | sheets | 56 | | 55 | 0 | 52 | 0 |
| Roll Weight - bone dry | grams | 107.84 | 1.76 | 96.12 | 0.56 | 279.36 | |
| Sheet Properties | | | | | | | |
| Ply | | 1 | | 1 | | 1 | |
| Length | mm | 287 | 3 | 268 | 1 | 285 | 1 |
| Width | mm | 285 | 1 | 282 | 1 | 280 | 1 |
| Absorbency | | | | | | | |
| Capacity - vertical | grams | 6.02 | 0.07 | 5.66 | 0.06 | 7.65 | 0.31 |
| Capacity - vertical | grams/gram | 8.07 | 0.13 | 8.13 | 0.22 | 10.60 | 0.19 |
| Wet-Out Time | seconds | 7.00 | 0.10 | 5.90 | 0.10 | 4.80 | 0.20 |
| Total Sheet Absorbency | grams | 47.7 | | 41.4 | | 59.1 | |
| Bulk | | | | | | | |
| Basis Weight - as is | #/2880 ft$^2$ | 43.54 | 1.05 | 40.07 | 0.75 | 42.33 | 2.18 |
| Basis Weight - bone dry | #/2880 ft$^2$ | 40.90 | 0.99 | 37.68 | 0.70 | 39.68 | 2.04 |
| Basis Weight - as is | g/m$^2$ | 73.81 | 1.78 | 67.92 | 1.27 | 71.755 | 3.694 |
| Basis Weight - bone dry | g/m$^2$ | 69.33 | 1.68 | 63.88 | 1.19 | 67.262 | 3.450 |
| Caliper 1-sheet | inches | 0.0292 | 0.0008 | 0.0275 | 0.0007 | 0.0310 | 0.0007 |
| Caliper 10-sheet | inches | 0.279 | 0.009 | 0.256 | 0.007 | 0.298 | 0.004 |
| Stack Bulk | cm$^3$/g | 9.610 | 0.150 | 9.560 | 0.330 | 10.57 | 0.64 |
| Strength | | | | | | | |
| GMT | | 1335 | | 1533 | | 1444 | |
| MD Tensile | grams/3" | 1437 | 96 | 1790 | 123 | 1694 | 157.14 |
| MD Stretch | % | 23.2 | 2.4 | 28.6 | 2.0 | 9.27 | 0.95 |
| MD TEA at Fail | GmCm/Cm$^2$ | 25.33 | 3.13 | 33.65 | 2.69 | 18.35 | 1.69 |
| MD Slope (A) | Kg | 5.06 | 0.41 | 3.66 | 0.28 | 19.77 | 2.68 |
| CD Tensile | grams/3" | 1240 | 104 | 1313 | | 1231 | 84 |
| CD Stretch | % | 13.7 | 0.6 | 15.0 | 1.2 | 14.75 | 1.21 |
| CD TEA at Fail | GmCm/Cm$^2$ | 15.90 | 1.55 | 21.12 | 1.79 | 19.38 | 2.87 |
| CD Slope (A) | Kg | 7.66 | 0.85 | 10.50 | 1.49 | 9.73 | 0.70 |
| Dry Burst | grams | 519.0 | 63.4 | 602.0 | 85.1 | 579 | 66 |
| Wet Strength | | | | | | | |
| CD Wet (pad) | grams | 644.1 | 30.1 | 877.7 | 57.0 | 788 | 52 |
| CD Wet Stretch | % | 9.7 | 0.4 | 11.6 | 1.3 | 9.9 | 0.40 |
| Wet CD TEA at Fail | GmCm/Cm$^2$ | 5.97 | 0.38 | 10.11 | 1.17 | 6.9 | 0.65 |
| Wet CD Slope (A) | Kg | 5.77 | 0.41 | 6.91 | 0.75 | | |
| CD Wet/Dry Ratio (pad) | % | 51.9 | | 66.8 | | 64.0 | |
| Dispensing | | | | | | | |
| Detach | grams | 1192 | | 1408 | 107 | 1728 | 733 |
| Detach/CD Ratio | | 1.0 | | 1.1 | | 1.40 | |
| Appearance | | | | | | | |
| Opacity - ISO | % | 74.95 | 0.79 | 74.61 | 0.73 | 72.33 | 2.34 |
| Brightness | % | 85.94 | 0.16 | 84.56 | 0.52 | 86.46 | 0.28 |

TABLE 2-continued

| Invention Samples (Additional Data) | | | | | | | |
|---|---|---|---|---|---|---|---|
| TB-1C Color L | L | 96.26 | 0.06 | 96.02 | 0.11 | 96.49 | 0.08 |
| a (red/green) | A | −1.04 | 0.05 | −0.79 | 0.04 | −0.81 | 0.04 |
| b (blue/yellow) | B | 5.04 | 0.05 | 5.81 | 0.24 | 5.02 | 0.14 |

| | | Example ID Number | | | | | |
|---|---|---|---|---|---|---|---|
| | | 10 | | 11 | | 12 | |
| Test | Units | Ave | Std. Dev. | Ave | Std. Dev. | Ave | Std. Dev. |
| Roll Properties | | | | | | | |
| Diameter | inches | 5.051 | 0.042 | 5.000 | 0.032 | 4.949 | 0.037 |
| Diameter | mm | 128.0 | 1 | 127.0 | 1.00 | 126.0 | 1.0 |
| Firmness - Kershaw | mm | 6.60 | 0.90 | 7.40 | 1 | 6.70 | 0.70 |
| Sheet Count | sheets | 56 | 0 | 56 | 0 | 56 | 0 |
| Roll Weight - bone dry | grams | 206.37 | | 211.68 | | 309.62 | |
| Sheet Properties | | | | | | | |
| Ply | | 1 | | 1 | | 1 | |
| Length | mm | 285 | 1 | 285 | 0 | 286 | 1 |
| Width | mm | 283 | 2 | 283 | 1 | 283 | 1 |
| Absorbency | | | | | | | |
| Capacity - vertical | grams | 7.02 | 0.39 | 6.09 | 0.27 | 6.85 | 0.70 |
| Capacity - vertical | grams/gram | 9.67 | 0.35 | 10.33 | 0.45 | 9.18 | 0.43 |
| Wet-Out Time | seconds | 4.6 | 0.10 | 3.60 | 0.10 | 5.00 | 0.20 |
| Total Sheet Absorbency | grams | 54.8 | | 47.6 | | 53.7 | |
| Bulk | | | | | | | |
| Basis Weight - as is | #/2880 $ft^2$ | 40.63 | 0.82 | 33.58 | 1.02 | 42.90 | 1.08 |
| Basis Weight - bone dry | #/2880 $ft^2$ | 38.09 | 0.77 | 31.54 | 0.95 | 40.26 | 1.00 |
| Basis Weight - as is | $g/m^2$ | 68.882 | 1.389 | 56.931 | 1.733 | 72.727 | 1.837 |
| Basis Weight - bone dry | $g/m^2$ | 64.569 | 1.31 | 53.478 | 1.61 | 68.25 | 1.69 |
| Caliper 1-sheet | inches | 0.0277 | 0.0007 | 0.0249 | 0.0060 | 0.0258 | 0.0070 |
| Caliper 10-sheet | inches | 0.264 | 0.009 | 0.249 | 0.006 | 0.250 | 0.0040 |
| Stack Bulk | $cm^3/g$ | 9.74 | 0.32 | 11.13 | 0.31 | 8.73 | 0.1700 |
| Strength | | | | | | | |
| GMT | | 1185 | | 1185 | | 1501 | |
| MD Tensile | grams/3" | 1280 | 133 | 1312 | 94 | 1596 | 191 |
| MD Stretch | % | 10.42 | 1 | 11.54 | 0.91 | 10.19 | 0.91 |
| MD TEA at Fail | $GmCm/Cm^2$ | 14.83 | 2.3 | 16.69 | 1.41 | 17.54 | 2.16 |
| MD Slope (A) | Kg | 13.88 | 1.44 | 12.53 | 1.16 | 17.69 | 2.78 |
| CD Tensile | grams/3" | 1097 | 98 | 1070 | 97 | 1413 | 80 |
| CD Stretch | % | 15.47 | 0.08 | 17.42 | 1.19 | 13.93 | 0.98 |
| CD TEA at Fail | $GmCm/Cm^2$ | 16.62 | 2 | 18.73 | 2.78 | 19.06 | 1.97 |
| CD Slope (A) | Kg | 7.49 | 0.74 | 6.25 | 0.63 | 10.86 | 1.40 |
| Dry Burst | grams | 473 | 55 | 474 | 85 | 558 | 62 |
| Wet Strength | | | | | | | |
| CD Wet (pad) | grams | 726 | 66 | 719 | 74 | 934 | 39 |
| CD Wet Stretch | % | 11.1 | 0.66 | 12.5 | 0.53 | 10.7 | 0.51 |
| Wet CD TEA at Fail | $GmCm/Cm^2$ | 6.9 | 0.63 | 7.7 | 0.80 | 8.6 | 0.68 |
| Wet CD Slope (A) | Kg | | | | | | |
| CD Wet/Dry Ratio (pad) | % | 66.2 | | 67.2 | | 66.1 | |
| Dispensing | | | | | | | |
| Detach | grams | 1417 | 369 | 1741 | 346.44 | 1693 | 364 |
| Detach/CD Ratio | | 1.29 | | 1.63 | | 1.20 | |
| Appearance | | | | | | | |
| Opacity - ISO | % | 73.06 | 2.43 | 63.61 | 3.34 | 74.74 | 1.67 |
| Brightness | % | 86.71 | 0.52 | 85.35 | 0.28 | 86.62 | 0.08 |
| TB-1C Color L | L | 96.61 | 0.13 | 96.2 | 0.06 | 96.66 | 0.02 |
| a (red/green) | A | −0.80 | 0.09 | −0.86 | 0.07 | −0.78 | 0.04 |
| b (blue/yellow) | B | 5.00 | 0.2 | 5.46 | 0.16 | 5.01 | 0.04 |

TABLE 2-continued

| Invention Samples (Additional Data) | | | | | |
|---|---|---|---|---|---|
| | | Example ID Number | | | |
| | | 13 | | 14 (2-ply) | |
| Test | Units | Ave | Std. Dev. | Avg. | Std. Dev. |
| Roll Properties | | | | | |
| Diameter | inches | 4.984 | 0.059 | 4.803 | 0.000 |
| Diameter | mm | 127.0 | 2.0 | 122.000 | 0.000 |
| Firmness - Kershaw | mm | 7.70 | 0.60 | 6.30 | 0.40 |
| Sheet Count | sheets | 56 | | 60 | 0 |
| Roll Weight - bone dry | grams | 247.31 | | 98.38 | 0.59 |
| Sheet Properties | | | | | |
| Ply | | 1 | | 2 | |
| Length | mm | 283 | 1 | 274 | 0 |
| Width | mm | 283 | 2 | 284 | 5 |
| Absorbency | | | | | |
| Capacity - vertical | grams | 6.42 | 0.33 | 6.03 | 0.06 |
| Capacity - vertical | grams/gram | 10.69 | 0.19 | 8.82 | 0.13 |
| Wet-Out Time | seconds | 3.70 | 0.10 | 3.60 | 0.10 |
| Total Sheet Absorbency | grams | 49.8 | | 45.5 | |
| Bulk | | | | | |
| Basis Weight - as is | #/2880 $ft^2$ | 34.53 | 0.899 | 40.53 | 0.33 |
| Basis Weight - bone dry | #/2880 $ft^2$ | 32.50 | 0.834 | 37.77 | 0.31 |
| Basis Weight - as is | $g/m^2$ | 58.537 | 1.525 | 68.72 | 0.56 |
| Basis Weight - bone dry | $g/m^2$ | 55.09 | 1.413 | 64.04 | 0.53 |
| Caliper 1-sheet | inches | 0.0258 | 0.0060 | 0.0257 | 0.0006 |
| Caliper 10-sheet | inches | 0.250 | 0.005 | 0.237 | 0.006 |
| Stack Bulk | $cm^3/g$ | 10.85 | 0.41 | 8.760 | 0.140 |
| Strength | | | | | |
| GMT | | 1174 | | 1729 | |
| MD Tensile | grams/3" | 1299 | 129 | 2153 | 158 |
| MD Stretch | % | 11.62 | 1.46 | 22.3 | 2.1 |
| MD TEA at Fail | $GmCm/Cm^2$ | 16.84 | 1.92 | 36.96 | 2.61 |
| MD Slope (A) | Kg | 12.56 | 1.84 | 7.02 | 0.33 |
| CD Tensile | grams/3" | 1061 | 127 | 1389 | 94 |
| CD Stretch | % | 18.49 | 0.94 | 13.8 | 1.0 |
| CD TEA at Fail | $GmCm/Cm^2$ | 19.55 | 3.47 | 23.79 | 2.67 |
| CD Slope (A) | Kg | 6.04 | 0.78 | 12.10 | 1.48 |
| Dry Burst | grams | 479 | 68 | 784.5 | 46.9 |
| Wet Strength | | | | | |
| CD Wet (pad) | grams | 762 | 81 | 469.8 | 33.4 |
| CD Wet Stretch | % | 13.8 | 0.62 | 9.2 | 0.8 |
| Wet CD TEA at Fail | $GmCm/Cm^2$ | 8.9 | 0.94 | 4.99 | 0.62 |
| Wet CD Slope (A) | Kg | | | | |
| CD Wet/Dry Ratio (pad) | % | 71.8 | | 33.8 | |
| Dispensing | | | | | |
| Detach | grams | 1605 | 339 | 1830 | 127 |
| Detach/CD Ratio | | 1.51 | | 1.3 | |
| Appearance | | | | | |
| Opacity - ISO | % | 64.34 | 1.22 | 76.51 | 1.15 |
| Brightness | % | 84.73 | 0.23 | 84.39 | 0.43 |
| TB-1C Color L | L | 96.01 | 0.07 | 93.91 | 0.15 |
| a (red/green) | A | −0.83 | 0.05 | 0.01 | 0.07 |
| b (blue/yellow) | B | 5.64 | 0.09 | 3.26 | 0.27 |

TABLE 3

Commercial Product Samples

| Example ID Number | Commercial Product Name | Month/Year Purchased | Basis Weight, Bone Dry (gsm) | Plies | Vertical Absorbent Capacity (g/g) | Wet-Out Time (s) | Stack Bulk |
|---|---|---|---|---|---|---|---|
| 15 | VIVA ® | May 2002 | 64.2 | 1 | 8.09 | 4.6 | 8.9 |
| 16 | SCOTT ® | January 2002 | 41.6 | 1 | 6.66 | 2.5 | 12.4 |
| 17 | Brawny ® | March 2000 | 46.3 | 2 | 4.35 | 4.3 | 10.2 |
| 18 | Coronet ® | March 2000 | 51.1 | 1 | 4.11 | 4.0 | 10.6 |
| 19 | Sparkle ® | September 2001 | 46.3 | 2 | 4.11 | 2.7 | 10.1 |
| 20 | Bounty Double Quilted ™ R | March 2002 | 38.2 | 2 | 10.84 | 3.1 | 10.8 |
| 21 | Bounty Double Quilted ™ XL | June 2001 | 45.6 | 2 | 9.01 | 2.9 | 9.4 |
| 22 | Bounty Double Quilted ™ XXL | June 2001 | 45.8 | 2 | 8.75 | 2.6 | 11 |

Example 23

To illustrate the ability of a moisture barrier to increase the Anisotropy Factor for a tissue web, a commercial paper towel was modified with added hydrophobic matter to impart spaced-apart stripes of the hydrophobic matter. The commercial paper towel was an uncreped throughdried single-ply SCOTT® Paper Towel (a 144-count Mega-Roll obtained in July 2003). Square samples measuring 100 mm on a side were cut with edges aligned with the machine direction and cross-machine direction. The 100 mm square samples had a conditioned mass of about 0.43 g. Two samples (Samples 1 and 2) were modified by applying four stripes or bands of silicone sealant (DAP® DowCorning Auto/Marine Sealant, Cat. No. 694, Dow Corning, Dayton, Ohio) across the samples at a 45° angle to the sides, such that the silicone stripes could be horizontal or vertical when the sample was suspended from a corner for the Vertical Absorbent Capacity test. The bands were about 0.5 to 0.8 cm wide and added 1.4 grams of mass to Sample 1 and 1.23 grams to Sample 2. The silicone was applied with the applicator tip cut to the narrowest setting. As a bead of silicone was applied across the sample on a first surface, it was gently worked into the sheet to cause the silicone to penetrate into the web. After partial curing of the silicone (about 30 minutes), each sample was inverted on a glossy coated paper sheet and additional silicone was applied to the obverse sides of the treated bands such that the bands were present on both surfaces of the sample, with substantially the same basis weight of silicone applied in each band. The samples were allowed to stand for about 1 hour longer before being wetted for three minutes according to the Vertical Absorbent Capacity procedure. After wetting, the sample was then suspended from a corner according the Vertical Absorbent Capacity procedure. Sample 1 was first tested with the stripes substantially horizontal. The wet weight after three minutes of drainage was 5.04 g. Relative to the dry weight (including the silicone mass) of 1.84 g, this corresponds to an estimated Vertical Absorbent Capacity of 1.74. Sample 1 was subsequently rewetted for three minutes again, and then hung with a different corner up such that the stripes were vertically aligned. The wet weight after three minutes of drainage was 4.41 g, corresponding to an estimated Rotated Vertical Absorbent Capacity of 1.40. If the treated sample were representative of a large number of similar samples, replicate testing of samples according to the Vertical Absorbent Capacity procedure, and the procedure for Rotated Vertical Absorbent Capacity, would be expected to give an Anisotropy Factor of about 1.74/1.40=1.24. The measured values of absorbent capacity given here were taken for a single sample with different orientations, in contrast to the recommended procedure of testing at least 5 distinct samples, and thus should be viewed as estimated values for absorbent capacity measured with larger sample sizes, but the use of a single sample is sufficient to highlight the creation of significant anisotropy through a pattern of liquid resistant material.

Testing with Sample 2, having a dry weight of 1.67 g, gave similar results. After the initial three minutes of soaking, the sample was suspended with the silicone stripes aligned vertically. The wet weight after three minutes of drainage was 4.22 g, corresponding to an estimated Rotated Vertical Absorbent Capacity of 1.53. The sample was soaked for three minutes again and drained with the stripes horizontal. The wet weight after three minutes was 5.16 g, corresponding to an estimated Vertical Absorbent Capacity 2.09. The ratio of the estimated Vertical Absorbent Capacity to the estimated Rotated Vertical Absorbent Capacity for Sample 2 was 2.09/1.53=1.37, which is the estimated Anisotropy Factor. As a check, Sample 2 was again wetted for three minutes and allowed to drain again for three minutes with the silicone stripes aligned vertically, yielding a wet weight of 4.35 g, within 3% of the previously measured value of 4.22 g, suggesting that drainage of a sample that had been previously rewetted and drained did not significantly alter the results relative to wetting and draining an initially dry sample, though this may not be the case when a sample comprises water-sensitive binder materials or otherwise is water dispersible.

Example 24

Related testing was done with a different moisture barrier material, SPRAYON® S00708 T.F.E. Dry Lube with DuPont Krytox® Dry Film, a fluoropolymer spray lubricant provided by Sherwin-Williams (Cleveland, Ohio). Stripes of applied T.F.E. (tetra-fluoroethylene) spray similar to those of FIG. 17 were created by masking 100 mm square samples of the SCOTT® paper towel (cut with sides aligned with the machine and cross-machine directions) with strips of wax-jet printing paper about 1.5 cm wide aligned with a 45° angle to the sides of the sample, such that about six stripes of tissue were uncovered. The masked tissue was then sprayed with the T.F.E. spray, resulting in multiple stripes that proved to be water resistant in that they remained substantially dry in appearance when the tissue was wetted. Four samples with an initial total conditioned mass of 1.70 g had a mass of 1.74 g after spraying the stripes of T.F.E. material. However, when tested for estimated Vertical Absorbent Capacity and Rotated Vertical Absorbent Capacity (stripes horizontal and vertical), the samples (only two were tested) proved to be substantially isotropic, both having an estimated Anisotropy Factor less than 1.01. Without wishing to be bound by theory, it is believed that the treated stripes did not present an effective barrier to vertical drainage, possibly because fluid could readily flow through internal pores in the web. Even though fiber surfaces may have been coated with the T.F.E. material, the applied mass may have been inadequate to block pores. It is also possible that some flow occurred over the surface of the stripes, where there was little added matter to hinder surface flow. In general, it is believed that the mass of added liquid resistant material needed for effective anisotropy in a treated tissue web may need to be greater than the roughly 2% of added matter in this case, such as about 5% or greater, 10% or greater, 20% or greater, 30% or greater, or 50% or greater added matter relative to the dry mass of the web. Again, without wishing to be bound by theory, it is believed that the silicone stripes were effective in creating significant anisotropy at least in part because they effectively blocked internal pores in the web. Some of the silicone resided on or above the surface of the web and may have created some degree of barrier to surface flow, though this is believed to be less important than the internal penetration and blocking of pores inside the web.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following sub-ranges: 1-4; 1-3; 1-2; 2-5; 2-4; 2-3; 3-5; 3-4; and 4-5.

It will be appreciated that the foregoing examples, given for purposes of illustration, are not to be construed as limiting the scope of this invention, which is defined by the following claims and all equivalents thereto.

We claim:

1. A low density paper product having one or more plies consisting essentially of hardwood kraft fibers, softwood kraft fibers or blends thereof and having a discontinuous moisture retardant coating on the surface thereof, said product having a Bulk of 10 cubic centimeters or greater per gram, a Vertical Absorbent Capacity from about 8.0 grams of water per gram of fiber to about 12 grams of water per gram of fiber, a Wet-Out Time from about 4.5 seconds to about 7 seconds and a cross-machine direction wet tensile strength of from about 700 to about 970 grams per 3 inches of sample width.

2. The product of claim 1 wherein the number of plies is one.

3. The product of claim 1 wherein the number of plies is two.

4. The product of claim 1 having an Anisotropy Factor of about 1.05 or greater.

5. The product of claim 1 having an Anisotropy Factor of about 1.1 or greater.

6. The product of claim 1 having an Anisotropy Factor of about 1.2 or greater.

7. The product of claim 1 having an Anisotropy Factor of about 1.5 or greater.

8. The product of claim 1 having an Anisotropy Factor of about 1.05 or greater.

9. The product of claim 1 having an Anisotropy Factor of from about 1.05 to about 2.5.

10. The product of claim 1 having an Anisotropy Factor of from about 1.1 to about 2.

11. The product of claim 1 wherein one or more of the plies is an uncreped throughdried ply.

* * * * *